US007513587B2

(12) United States Patent
Hoshiyama et al.

(10) Patent No.: US 7,513,587 B2
(45) Date of Patent: Apr. 7, 2009

(54) PRINTING METHOD AND PRINTING SYSTEM

(75) Inventors: Yoshiko Hoshiyama, Nagano-ken (JP); Hirokazu Nunokawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 333 days.

(21) Appl. No.: 11/178,613

(22) Filed: Jul. 12, 2005

(65) Prior Publication Data

US 2006/0050097 A1 Mar. 9, 2006

(30) Foreign Application Priority Data

Jul. 12, 2004 (JP) ..... 2004-204819
Sep. 9, 2004 (JP) ..... 2004-262199

(51) Int. Cl.
*B41J 29/38* (2006.01)

(52) U.S. Cl. ..... 347/14; 347/16

(58) Field of Classification Search ..... 347/14
See application file for complete search history.

(56) References Cited

U.S. PATENT DOCUMENTS 6,250,737 B1 * 6/2001 Matsubara et al. ..... 347/40

FOREIGN PATENT DOCUMENTS

JP 2003-118097 A 4/2003

* cited by examiner

*Primary Examiner*—Luu Matthew
*Assistant Examiner*—Brian J Goldberg
(74) *Attorney, Agent, or Firm*—Sughrue Mion, PLLC

(57) ABSTRACT

The invention relates to a printing method that repeats in alternation a carrying operation of carrying a medium in a carrying direction, and a formation operation of forming an image on the medium by ejecting ink from a plurality of nozzles that are aligned in the carrying direction and that move in a movement direction. In this method: (a) a first blank section arranged along the movement direction is detected from an image to be printed in a certain formation operation; (b) a second blank section arranged along the movement direction is detected from an image to be printed in a next formation operation; and (c) if the first and second blank sections are detected and a width in the carrying direction of an image to be printed in the next formation operation downstream in the carrying direction from the second blank section is smaller than a width in the carrying direction of the first blank section, then the width in the carrying direction of the first blank section is shortened to print, in the certain formation operation, an image to be printed between the first blank section and the second blank section.

9 Claims, 22 Drawing Sheets

ABC
XYZ (ordinary printing method)

(reference example printing method)

(printing method of present embodiment)

ABC
XYZ

PRINTING METHOD AND PRINTING SYSTEM

CROSS-REFERENCE TO RELATED APPLICATIONS

The present application claims priority upon Japanese Patent Application No. 2004-204819 filed on Jul. 12, 2004 and Japanese Patent Application No. 2004-262199 filed on Sep. 9, 2004, which are herein incorporated by reference.

FIELD OF THE INVENTION

The present invention relates to printing methods and printing systems.

DESCRIPTION OF THE RELATED ART

Printing apparatuses (ink jet printers), which are provided with a carry unit for carrying a medium (paper, cloth, OHP sheets, and so on) in a carrying direction and a carriage for moving a plurality of nozzles, which are lined up in the carrying direction, in a movement direction, are well known. This type of printing apparatus repeats in alternation a dot formation operation for forming an image on the medium by ejecting ink from the plurality of nozzles which move and a carrying operation for causing the carry unit to carry the medium, thereby forming an image on the medium.

However, printed images which are formed by two dot formation operations are susceptible to a deterioration in image quality at the seam.

The present invention has an object of suppressing deterioration in image quality at the seam between printed images.

SUMMARY OF THE INVENTION

A first main aspect of the invention for achieving the above object is a printing method which repeats in alternation a carrying operation of carrying a medium in a carrying direction, and a formation operation of forming an image on the medium by ejecting ink from a plurality of nozzles that are aligned in the carrying direction and that move in a movement direction. The method includes the steps of:

detecting, from an image to be printed in a certain formation operation, a first blank section that is arranged along the movement direction;

detecting, from an image to be printed in the next formation operation, a second blank section that is arranged along the movement direction; and if the first blank section and the second blank section are detected and a width in the carrying direction of an image to be printed in the next formation operation on a downstream side in the carrying direction from the second blank section is smaller than a width in the carrying direction of the first blank section, then shortening the width in the carrying direction of the first blank section in order to print, in the certain formation operation, an image to be printed between the first blank section and the second blank section.

A second main aspect of the invention for achieving the above object is a printing method which repeats in alternation a carrying operation of carrying a medium by a predetermined carry amount, and a formation operation of forming an image on the medium by ejecting ink from a plurality of nozzles that are aligned in the carrying direction and that move in a movement direction. The method includes the steps of:

detecting, from an image to be printed in a certain formation operation, a blank section that is arranged along the movement direction; and if the blank section is detected, then printing, in the certain formation operation, an image to be printed on a downstream side in the carrying direction from the blank section, carrying the medium by the predetermined carry amount, and printing, in the next formation operation, an image to be printed on an upstream side in the carrying direction from the blank section.

Features and objects of the present invention other than the above will be made clear by reading the present specification with reference to the accompanying drawings.

Figure 1:
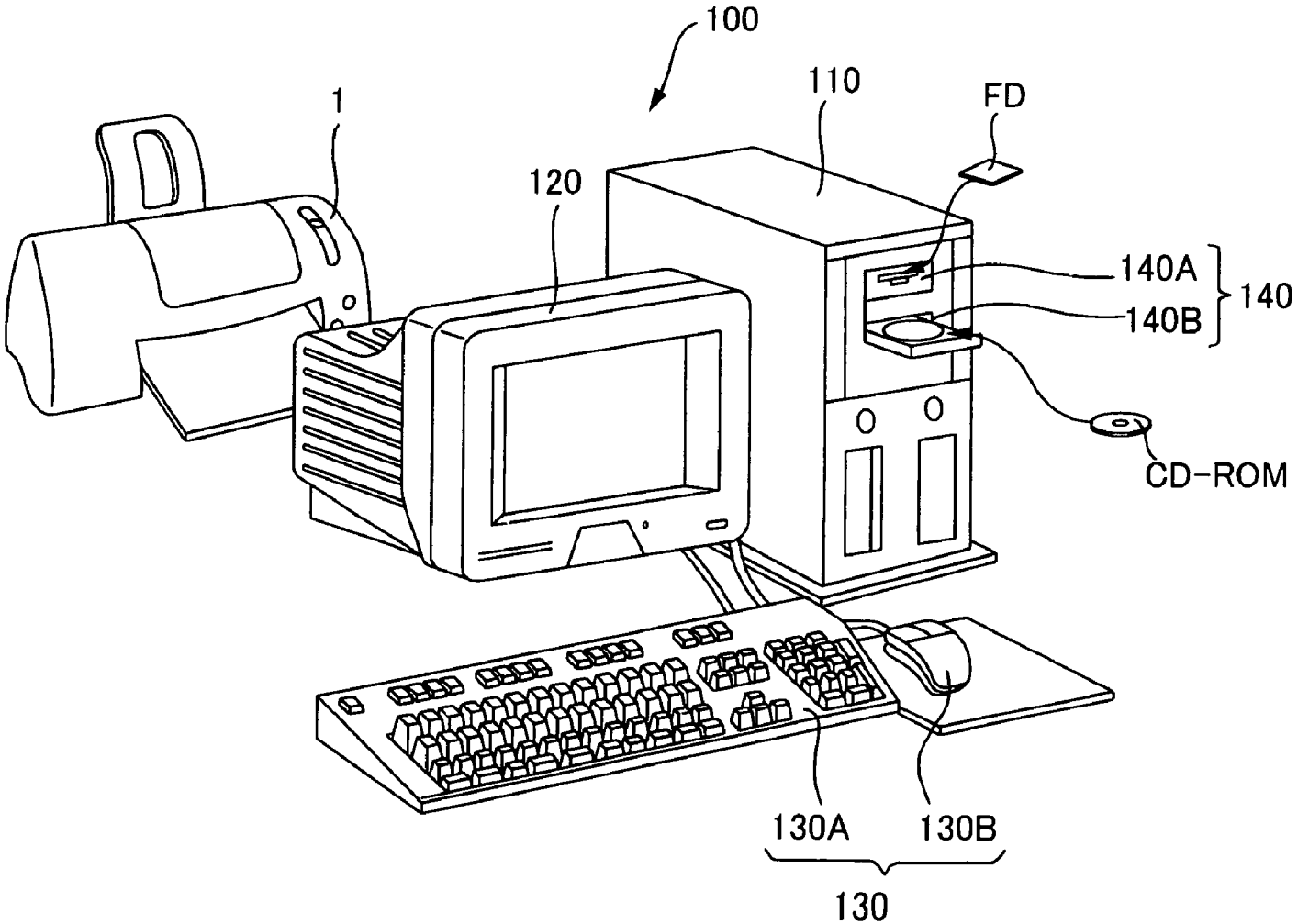
FIG. 1 is an explanatory diagram of an overall configuration of a printing system.

In order to facilitate a more complete understanding of the present invention and the advantages thereof, reference is now made to the following description taken in conjunction with the accompanying drawings.

DESCRIPTION OF PREFERRED EMBODIMENTS

Overview of the Disclosure

At least the following matters will be made clear by the description of the present specification and the accompanying drawings.

A printing method which repeats in alternation a carrying operation of carrying a medium in a carrying direction, and a formation operation of forming an image on the medium by ejecting ink from a plurality of nozzles that are aligned in the carrying direction and that move in a movement direction, includes the steps of:

detecting, from an image to be printed in a certain formation operation, a first blank section that is arranged along the movement direction;

detecting, from an image to be printed in the next formation operation, a second blank section that is arranged along the movement direction; and if the first blank section and the second blank section are detected and a width in the carrying direction of an image to be printed in the next formation operation on a downstream side in the carrying direction from the second blank section is smaller than a width in the carrying direction of the first blank section, then shortening the width in the carrying direction of the first blank section in order to print, in the certain formation operation, an image to be printed between the first blank section and the second blank section.

With this printing method, no deterioration of image quality at the seam of printed images occurs.

In this printing method, it is preferable that the plurality of nozzles can be moved back and forth; and the formation operation is performed while the plurality of nozzles move in a forward-pass direction, and the formation operation is performed while the plurality of nozzles move in a return-pass direction after the carrying operation is performed. This is particularly effective for printing systems which perform bi-directional printing.

In this printing method, it is preferable that, if the first blank section is made up of a plurality of blank sections and the width in the carrying direction of the image to be printed in the next formation operation on the downstream side in the carrying direction from the second blank section is smaller than a total width in the carrying direction of the plurality of blank sections, then the width in the carrying direction of the first blank section is shortened.

In this printing method, it is preferable that, when shortening the width in the carrying direction of the first blank section, a width in the carrying direction of each of the plurality of blank sections is shortened in accordance with the width in the carrying direction of each of the blank sections. This makes it possible to achieve a printed image closer to the original image.

In this printing method, it is preferable that, if the width in the carrying direction of the image to be printed in the next formation operation on the downstream side in the carrying direction from the second blank section is equal to or below a threshold value, then the width in the carrying direction of the first blank section is shortened. This reduces the difference between the original image and the printed image.

In this printing method, it is preferable that the width in the carrying direction of the first blank section within the image that is made up of pixel data corresponding to pixels arranged in a matrix is shortened by rearranging the pixel data.

In this printing method, it is preferable that the first blank section and the second blank section are detected after halftone processing for lowering a gradation value of the pixel data has been performed. This reduces the calculation load.

In this printing method, it is preferable that the image is a text. This method is particularly effective for text because there are many blanks between lines.

A printing system includes:

(A) a carry unit that carries a medium in a carrying direction;

(B) a carriage that moves, in a movement direction, a plurality of nozzles that are aligned in the carrying direction; and (C) a controller that repeats in alternation a formation operation of forming an image on the medium by causing ejection of ink from the plurality of nozzles that are moving, and a carrying operation of causing the carry unit to carry the medium, wherein if there is a first blank section that is arranged along the movement direction within an image to be printed in a certain formation operation, there is a second blank section that is arranged along the movement direction within an image to be printed in the next formation operation, and a width in the carrying direction of an image to be printed in the next formation operation on a downstream side in the carrying direction from the second blank section is smaller than a width in the carrying direction of the first blank section, then the controller shortens the width in the carrying direction of the first blank section and prints, in the certain formation operation, an image to be printed between the first blank section and the second blank section.

With this printing system, no deterioration of image quality at the seam of the printed images occurs.

Further, a storage medium storing a program, includes:

a code for causing a print control apparatus to control a printing apparatus for repeating in alternation a carrying operation for carrying a medium in a carrying direction and a formation operation for forming an image on the medium by ejecting ink from a plurality of nozzles which are lined up in the carrying direction and move in a movement direction;

a code for causing the print control apparatus to detect a first blank section that is arranged along the movement direction from an image to be printed during a certain formation operation;

a code for causing the print control apparatus to detect a second blank section that is arranged along the movement direction from an image to be printed during the next formation operation; and a code for causing the print control apparatus to shorten the width in the carrying direction of the first blank section in order to print an image to be printed between the first blank section and the second blank section during the certain formation operation, if the first blank section and the second blank section have been detected and the width in the carrying direction of an image to be printed downstream in the carrying direction from the second blank section during the next formation operation is narrower than the width in the carrying direction of the first blank section.

With this program, no deterioration of image quality at the seam of the printed images occurs.

Further, a storage medium storing a program, includes:

a code for causing a printing apparatus to repeat in alternation a carrying operation for carrying a medium in a carrying direction, and a formation operation for forming an image on the medium by ejecting ink from a plurality of nozzles which are lined up in the carrying direction and move in a movement direction; and a code for, when there is a first blank section, which is arranged along the movement direction, within an image to be printed during a certain formation operation, there is a second blank section, which is arranged along the movement direction, within an image to be printed in the next formation operation, and the width in the carrying direction of an image to be printed downstream in the carrying direction from the second blank section during the next formation operation is narrower than the width in the carrying direction of the first blank section, shortening the width in the carrying direction of the first blank section, and causing the printing apparatus to print the image to be printed between the first blank section and the second blank section during the certain formation operation.

With this program, no deterioration of image quality at the seam of the printed images occurs.

A printing method which repeats in alternation a carrying operation of carrying a medium by a predetermined carry amount, and a formation operation of forming an image on the medium by ejecting ink from a plurality of nozzles that are aligned in the carrying direction and that move in a movement direction, includes the steps of:

detecting, from an image to be printed in a certain formation operation, a blank section that is arranged along the movement direction; and if the blank section is detected, then printing, in the certain formation operation, an image to be printed on a downstream side in the carrying direction from the blank section, carrying the medium by the predetermined carry amount, and printing, in the next formation operation, an image to be printed on an upstream side in the carrying direction from the blank section.

With this printing method, it is possible to eliminate seams in the printed image and perform printing at a constant carry amount.

In this printing method, it is preferable that, if there is a blank section that is arranged along the movement direction within the image to be printed in the certain formation operation, there is an other blank section that is arranged along the movement direction within an image to be printed in the next formation operation, and a width in the carrying direction of an image to be printed between the two blank sections is larger than a width in the carrying direction of an image that can be formed on the medium with the formation operation, then the image to be printed on the upstream side in the carrying direction from the blank section that is within the image to be printed in the certain formation operation is printed in the certain formation operation. With this, it is possible to expand the blank section as needed.

In this printing method, it is preferable that the plurality of nozzles can be moved back and forth; and the formation operation is performed while the plurality of nozzles move in a forward-pass direction, and after the carrying operation is performed, the formation operation is performed while the plurality of nozzles move in a return-pass direction. This is particularly effective for printing systems which perform bi-directional printing.

In this printing method, it is preferable that, if there are a plurality of blank sections that are each arranged along the movement direction within the image to be printed in the certain formation operation, then an image to be printed on the downstream side in the carrying direction from a blank section on the upstream side of among the plurality of blank sections is printed in the certain formation operation, the medium is carried by the predetermined carry amount, and an image to be printed on the upstream side in the carrying direction from the blank section on the upstream side of among the plurality of blank sections is printed in the next formation operation.

In this printing method, it is preferable that a width in the carrying direction of each of the plurality of blank sections is expanded in accordance with the width in the carrying direction of each of the blank sections. This makes it possible to achieve a printed image closer to the original image.

In this printing method, it is preferable that, if a width in the carrying direction of an image to be printed in the certain formation operation on the upstream side in the carrying direction from the blank section is equal to or below a threshold value, then the width in the carrying direction of the blank section is expanded. This reduces the difference between the original image and the printed image.

In this printing method, it is preferable that the width in the carrying direction of the blank section within the image that is made up of pixel data corresponding to pixels arranged in a matrix is expanded by rearranging the pixel data.

In this printing method, it is preferable that the blank section is detected after halftone processing for lowering a gradation value of pixel data has been performed. This reduces the calculation load.

In this printing method, it is preferable that the image is a text. This method is particularly effective for text because there are many blanks between lines.

A printing system includes:

(A) a carry unit that carries a medium in a carrying direction;

(B) a carriage that moves, in a movement direction, a plurality of nozzles that are aligned in the carrying direction; and (C) a controller that repeats in alternation a formation operation of forming an image on the medium by causing ejection of ink from the plurality of nozzles that are moving, and a carrying operation of causing the carry unit to carry the medium by a predetermined carry amount, wherein if there is a blank section that is arranged along the movement direction within an image to be printed in a certain formation operation, then the controller prints, in the certain formation operation, an image to be printed on a downstream side in the carrying direction from the blank section, carries the medium by the predetermined carry amount, and prints, in the next formation operation, an image to be printed on an upstream side in the carrying direction from the blank section.

With this printing system, it is possible to eliminate seams in the printed image and perform printing at a constant carry amount.

Further, a storage medium storing a program, includes:

a code for causing a print control apparatus to control a printing apparatus for repeating in alternation a carrying operation for carrying a medium by a predetermined carry amount and a formation operation for forming an image on the medium by ejecting ink from a plurality of nozzles which are lined up in the carrying direction and move in a movement direction;

a code for causing the print control apparatus to detect a blank section, which is arranged along the movement direction, within an image to be printed during a certain formation operation; and a code for, when the blank section is detected, causing the print control apparatus to expand the width in the carrying direction of the blank section in order to print during the certain formation operation an image to be printed downstream in the carrying direction from the blank section, to carry the medium by the predetermined carry amount, and to print an image to be printed upstream in the carrying direction from the blank section during the next formation operation.

With this program, it is possible to eliminate seams in the printed image and perform printing at a constant carry amount.

Further, a storage medium storing a program, includes:

a code for causing a printing apparatus to repeat in alternation a carrying operation for carrying a medium by a predetermined carry amount and a formation operation for forming an image on the medium by ejecting ink from a plurality of nozzles which are lined up in the carrying direction and move in a movement direction; and a code for, when a blank section, which is arranged along the movement direction, is detected within an image to be printed during a certain formation operation, causing the printing apparatus to:

print during the certain formation operation an image to be printed downstream in the carrying direction from the blank section;

carry the medium by the predetermined carry amount; and print during the next formation operation an image to be printed upstream in the carrying direction from the blank section.

With this program, it is possible to eliminate seams in the printed image and perform printing at a constant carry amount.

Configuration of Printing System

An embodiment of a printing system is described next with reference to the drawings. However, the description of the following embodiment also includes implementations relating to a computer program and a storage medium storing a computer-program, for example.

FIG. 1 is an explanatory drawing showing an external configuration of a printing system. The printing system 100 is provided with a printer 1 and a computer 110. The printer 1 is a printing apparatus for printing images on a medium such as paper, cloth, or film. The computer 110 is communicably connected to the printer 1, and outputs print data corresponding to an image to be printed to the printer 1 in order to print the image with the printer 1. The computer 110 is a print control apparatus, as it controls the printer 1 via the print data.

The printing system 100 is also provided with a display device 120, an input device 130, and a record/play device 140. The display device 120 is provided with a display, and displays a user interface of, for example, a printer driver. The input device 130 is for example a keyboard 130A and a mouse 130B, and is used to operate an application program or adjust the settings of the printer driver, for example, in accordance with the user interface that is displayed on the display device 120. A flexible disk drive device 140A or a CD-ROM drive device 140B are employed as the record/play device 140, for example.

The printer driver is installed on the computer 110. The printer driver is a program for achieving the function of displaying the user interface on the display device 120, and in addition it also achieves the function of converting, into print data, image data that has been output from the application program. The printer driver is stored on a storage medium (a computer-readable storage medium) such as a flexible disk FD or a CD-ROM. Further, the printer driver can be downloaded onto the computer 110 via the Internet. It should be noted that this program is composed of codes for achieving various functions.

Configuration of Printer and Computer

<Configuration of Printer and Computer>

Figure 2:
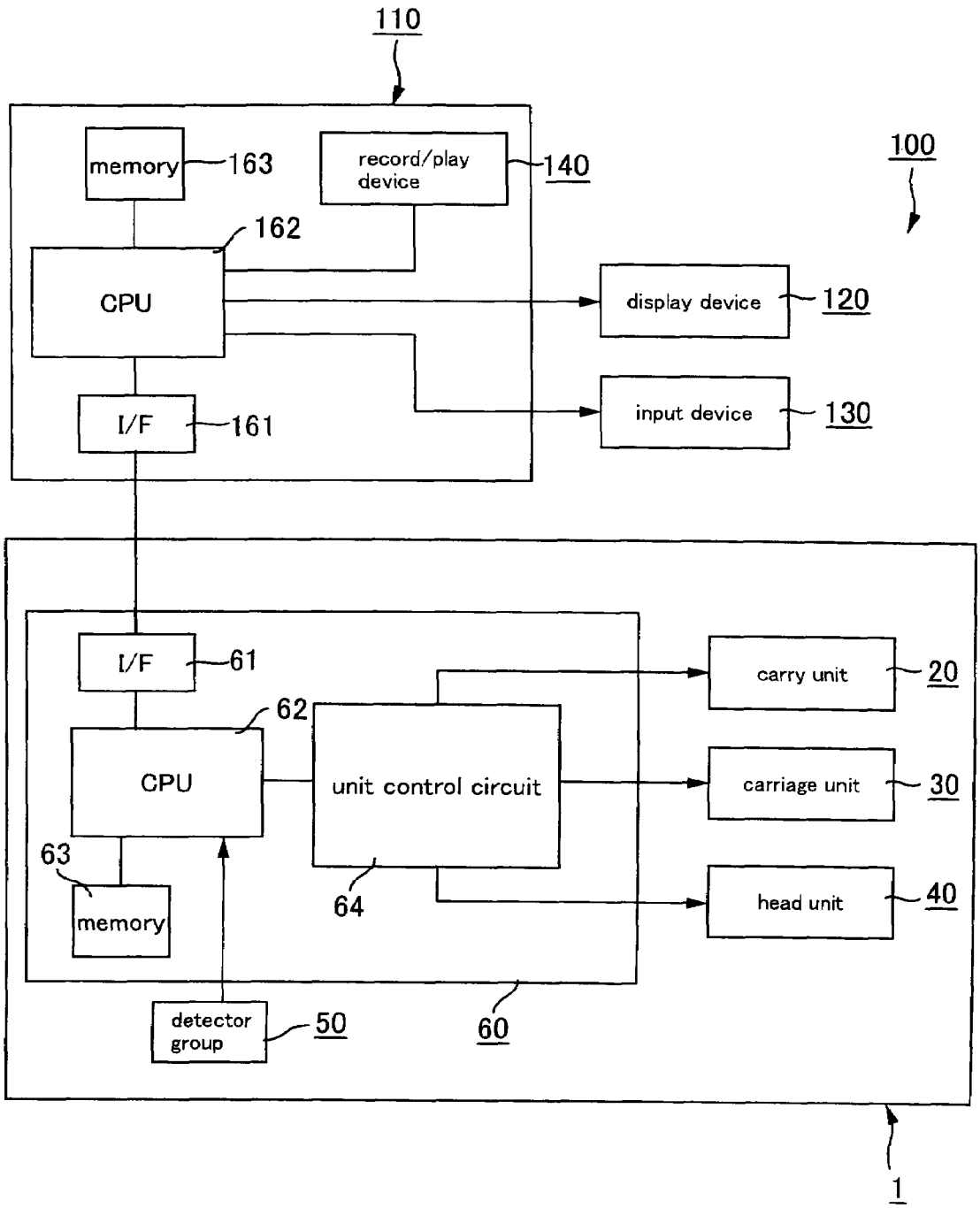
FIG. 2 is a block diagram of an overall configuration of a printer.

FIG. 2 is a block diagram of the overall configuration of the computer 110 and the printer 1 of the present embodiment.

The computer 110 according to the present embodiment is provided with an interface section 161, a CPU 162, and a memory 163. The interface section 161 exchanges data between the printer 1, which is an external device, and the computer 110. The CPU 162 is an arithmetic processing device for carrying out overall control of the computer 110. The memory 163 is a storage element for allocating work areas, areas for storing programs such as printer drivers, and so on. The CPU 162 generates print data from image data and transmits the print data to the printer 1 in accordance with the printer driver which is stored in the memory 163. By installing the printer driver in the computer 110, the CPU 162 and the memory 163 act as a computer-side controller for controlling the printer 1 via the print data.

The printer 1 according to the present embodiment is provided with carry unit 20, a carriage unit 30, a head unit 40, a detector group 50, and a printer-side controller 60. The printer 1, which receives print data from the computer 110, which is an external device, controls each unit (the carry unit 20, the carriage unit 30, and the head unit 40) using the printer-side controller 60. The printer-side controller 60 controls each unit in accordance with the print data that is received from the computer 110 and prints an image on a paper. The conditions within the printer 1 are monitored by the detector group 50, which outputs the detection results to the printer-side controller 60. The printer-side controller 60 controls each unit based on the detection results output from the detector group 50.

The printer-side controller 60 is a control unit for carrying out control of the printer. The printer-side controller 60 is provided with an interface section 61, a CPU 62, a memory 63, and a unit control circuit 64. The interface section 61 exchanges data between the computer 110, which is an external device, and the printer 1. The CPU 62 is an arithmetic processing device for carrying out overall control of the printer. The memory 63 is for allocating work areas, areas for storing programs of the CPU 62, and so on, and is provided with a storage means such as a RAM or an EEPROM. The CPU 62 controls each unit via the unit control circuit 64 in accordance with programs stored in the memory 63.

It should be noted that the computer-side controller (the CPU 162 and the memory 163) and the printer-side controller 60 act as a controller for controlling the overall printing system. The printer driver, which is stored in the memory 163 on the computer side, causes the computer 110 to generate print data and send the print data to the printer 1. The programs stored in the memory 63 on the printer side cause the carry unit 20 to carrying the paper, the carriage unit 30 to move the carriage, and the head unit 40 to eject ink, according to the print data. For this reason, the printer driver and the printer-side programs act together as a program for causing the printing system to carry out printing.

Figure 3:
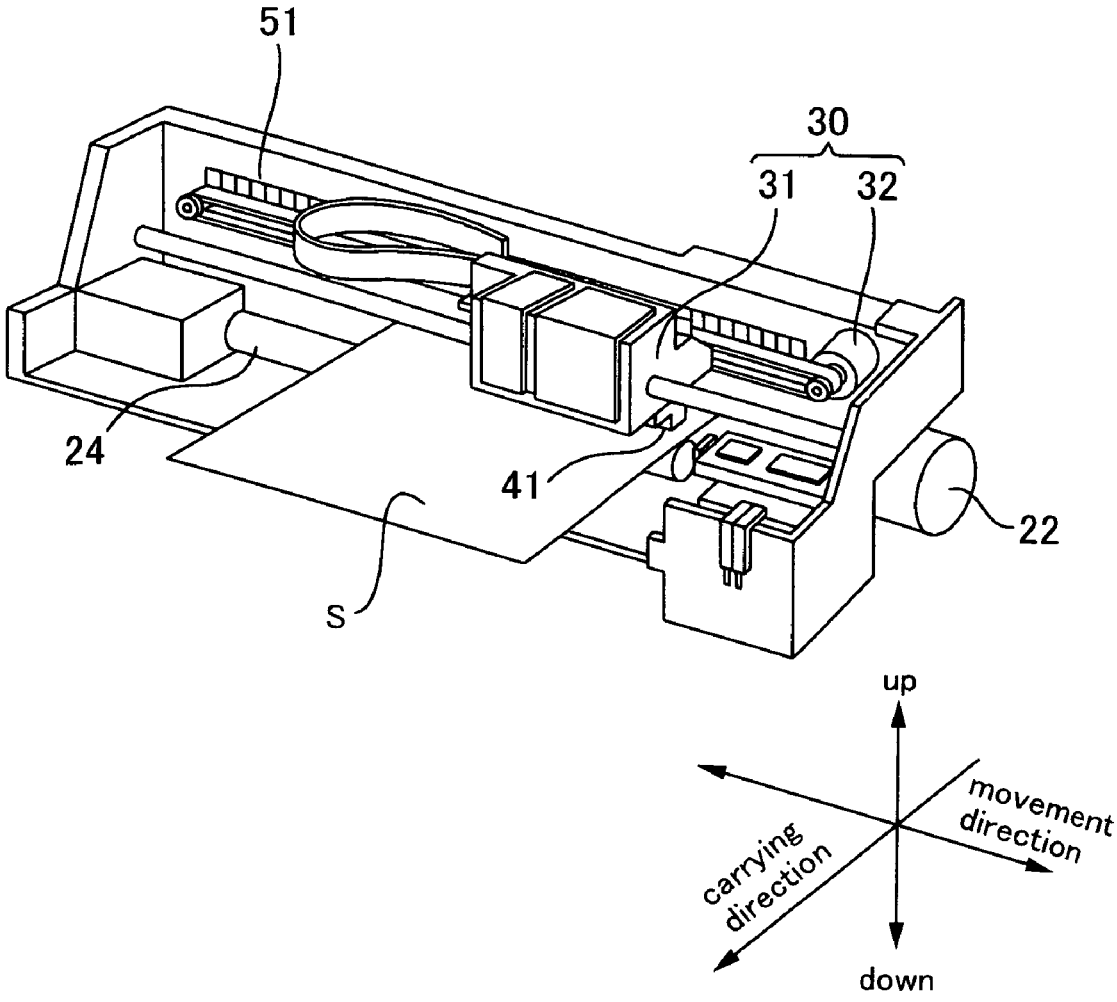
FIG. 3 is a schematic diagram of an overall configuration of the printer.
Figure 4:
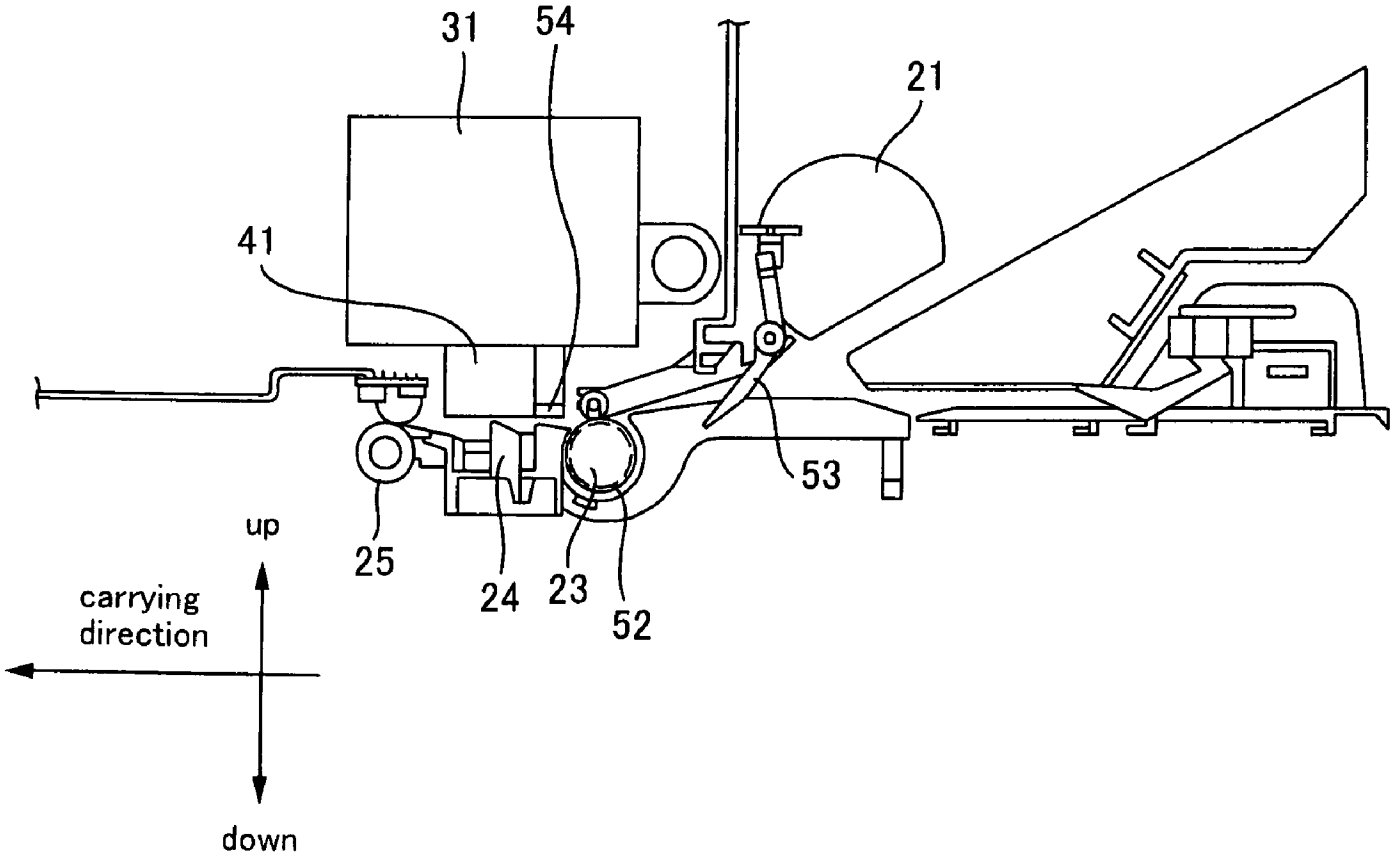
FIG. 4 is a lateral sectional view of the overall configuration of the printer.

FIG. 3 is a schematic diagram of the overall configuration of the printer 1 of the present embodiment. FIG. 4 is lateral sectional view of the overall configuration of the printer 1 of the present embodiment. The basic configuration of the printer according to the present embodiment is described below.

The carry unit 20 is for feeding a medium (for example, a paper S) to a printable position and carrying the paper in a predetermined direction (hereafter referred to as the carrying direction) by a predetermined carry amount during printing. In other words, the carry unit 20 functions as a carrying mechanism (a carrying means) for carrying paper. The carry unit 20 is provided with a paper supply roller 21, a carrying motor 22 (hereafter also referred to as a PF motor), a carrying roller 23, a platen 24, and a paper discharge roller 25. However, the carry unit 20 does not necessarily have to include all of these component elements in order to function as a carrying mechanism. The paper supply roller 21 is a roller for supplying, to the printer, paper that has been inserted into a paper insert opening. The paper supply roller 21 has a cross-sectional shape in the shape of the letter D, and the length of its circumferential portion is set longer than the carrying distance to the carrying roller 23, so that the paper can be carried up to the carrying roller 23 using this circumferential portion. The carrying motor 22 is a motor for carrying paper in the carrying direction, and is composed of a DC motor, for example. The carrying roller 23 is a roller for carrying the paper S that has been supplied by the paper supply roller 21 up to a printable region, and is driven by the carrying motor 22. The platen 24 supports the paper S during printing. The paper discharge roller 25 is a roller for discharging the paper S to the exterior of the printer and is provided downstream in the carrying direction relative to the printable region. The paper discharge roller 25 rotates in synchronization with the carrying roller 23.

The carriage unit 30 is for causing the head to move (hereafter also referred to as "to scan") in a predetermined direction (hereafter also referred to as the "movement direction"). The carriage unit 30 is provided with a carriage 31 and a carriage motor 32 (also referred to as a "CR motor"). The carriage 31 can be moved back and forth in the movement direction (thus, the head moves in the movement direction). Also, the carriage 31 detachably holds an ink cartridge containing ink. The carriage motor 32 is a motor for moving the carriage 31 in the movement direction, and is composed of a DC motor, for example.

The head unit 40 is for ejecting ink onto paper. The head unit 40 is provided with a head 41. The head 41 is provided with a plurality of nozzles and ejects ink intermittently from each nozzle. The head 41 is provided to the carriage 31. Thus, when the carriage 31 moves in the movement direction, the head 41 also moves in the movement direction. A dot line (raster line) is formed on the paper in the movement direction as a result of the head 41 intermittently ejecting ink while moving in the movement direction.

The detector group 50 includes a linear encoder 51, a rotary encoder 52, a paper detection sensor 53, an optical sensor 54, and so on. The linear encoder 51 is for detecting the position of the carriage 31 in the movement direction. The rotary-type encoder 52 is for detecting the amount of rotation of the carrying roller 23. The paper detection sensor 53 is for detecting the position of the front end of the paper to be printed. The paper detection sensor 53 is provided to a position where it can detect the position of the front end of the paper as the paper is being supplied toward the carrying roller 23 by the paper supply roller 21. The paper detection sensor 53 is a mechanical sensor that detects the front end of the paper using a mechanical mechanism. More specifically, the paper detection sensor 53 has a lever that can be rotated in the carrying direction, and this lever is disposed such that it protrudes into the path along which the paper is carried. In this way, the front end of the paper comes into contact with the lever and the lever is rotated, and thus the paper detection sensor 53 detects the position of the front end of the paper by detecting the movement of the lever. The optical sensor 54 is mounted onto the carriage 31. The optical sensor 54 detects whether or not paper is present by its light-receiving section detecting reflected light from light that has been irradiated onto the paper from a light-emitting section. The optical sensor 54 can detect the position of the edges of the paper while being moved by the carriage 31, so as to detect the width of the paper. The optical sensor 54 can further detect the front end of the paper (the downstream edge portion in the carrying direction; also referred to as the top edge) and the rear end (the upstream edge portion in the carrying direction; also referred to as the bottom edge). The optical sensor 54 optically detects the edge portions of the paper, and thus has higher detection accuracy than the mechanical paper detection sensor 53.

<The Nozzles>

Figure 5:
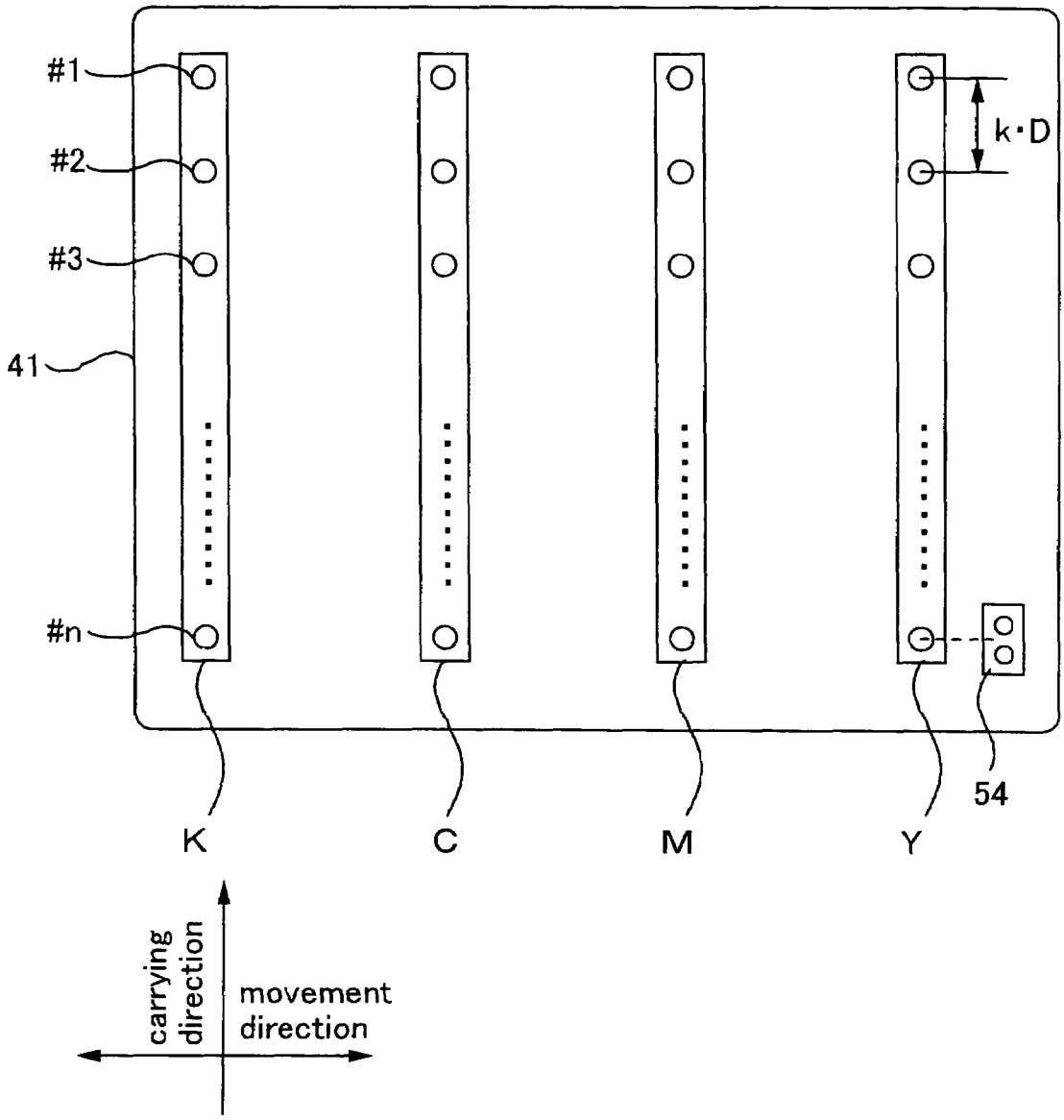
FIG. 5 is an explanatory diagram showing an arrangement of nozzles.

FIG. 5 is an explanatory diagram showing an arrangement of the nozzles in a lower surface of the head 41. A black ink nozzle group K, a cyan ink nozzle group C, a magenta ink nozzle group M, and a yellow ink nozzle group Y are formed in the lower surface of the head 41. Each nozzle group is provided with a plurality of nozzles (in the present embodiment, 180), which are ejection openings for ejecting the various color inks.

The plurality of nozzles of each nozzle group are arranged in a row at a constant spacing (nozzle pitch: k·D) in the carrying direction. Here D is the minimum dot pitch in the carrying direction (that is, spacing at the maximum resolution of dots formed on the paper S). Further, k is an integer of 1 or more. For example, if the nozzle pitch is 180 dpi ($1/180$ inch) and the dot pitch in the carrying direction is 720 dpi ($1/720$), then k=4.

The nozzles of each of the nozzle groups are assigned a number (#1 through #180) that becomes smaller, the further downstream the nozzle is. That is, the nozzle #1 is positioned further downstream in the carrying direction than the nozzle #180. Also, the optical sensor 54 is provided substantially at the same position as the nozzle #180, which is on the side furthest upstream as regards its position in the paper carrying direction.

Each nozzle is provided with an ink chamber (not shown) and a piezo element. The ink chamber contracts and expands as driven by the piezo element, thus ejecting ink droplets from the nozzles.

<The Printer Driver>

Figure 6:
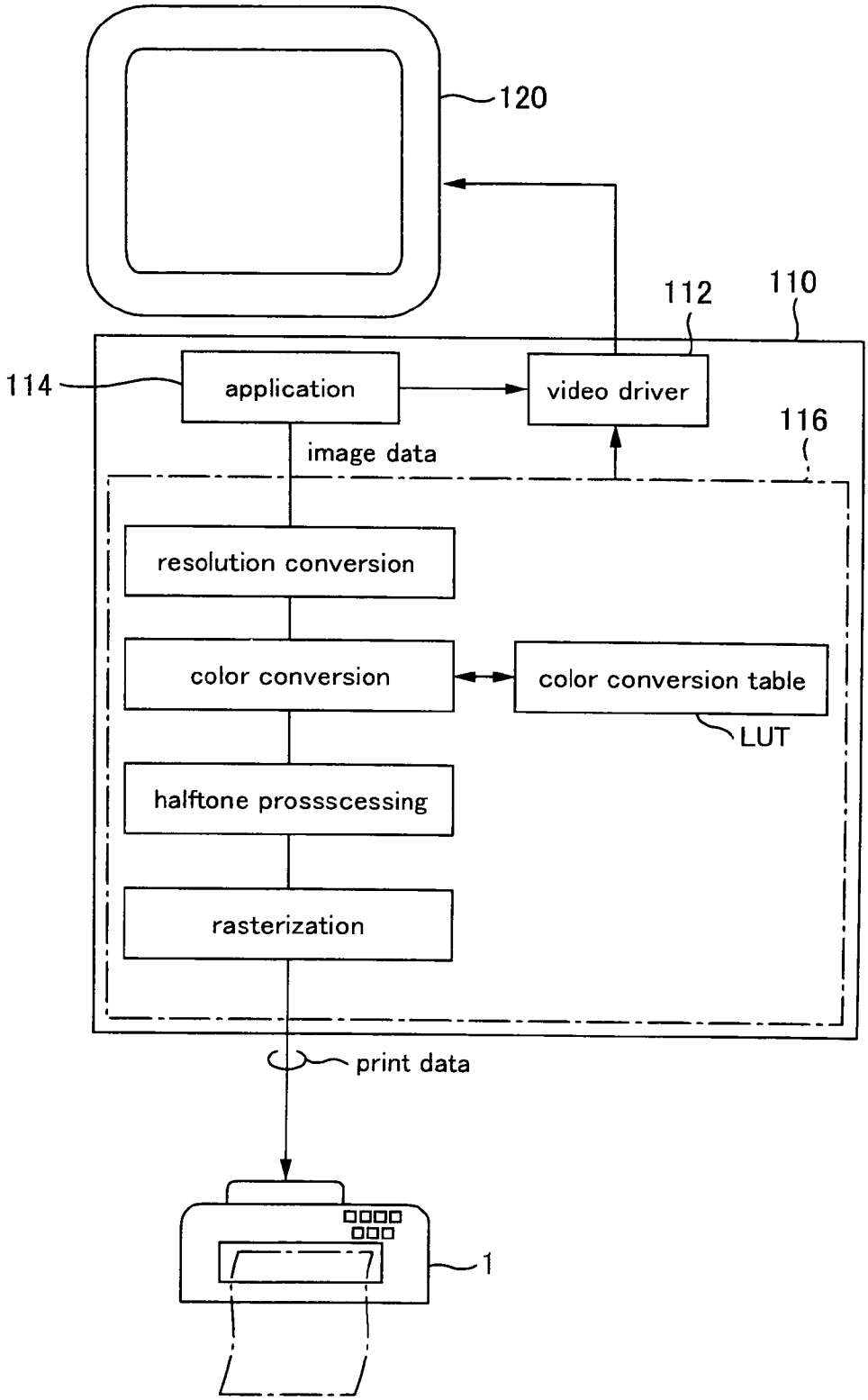
FIG. 6 is an explanatory diagram of processes carried out by a printer driver.

FIG. 6 is a schematic explanatory diagram of basic processes carried out by a printer driver. Structural elements that have already been described are assigned identical reference numerals and thus further description of them is omitted.

On the computer 110, computer programs such as a video driver 112, an application program 114, and a printer driver 116 operate under an operating system installed on the computer. The video driver 112 has the function of displaying, for example, the user interface on the display device 120 in accordance with display commands from the application program 114 and the printer driver 116. The application program 114, for example, has functions such as enabling image editing and creates data related to images (image data). A user can give an instruction to print an image edited by the application program 114 via the user interface of the application program 114. Upon receiving the print instruction, the application program 114 outputs the image data to the printer driver 116.

The printer driver 116 receives the image data from the application program 114, converts the image data to print data, and outputs the print data to the printer. Here, "print data" refers to data in a format that can be interpreted by the printer 1 and that includes various types of command data and pixel data. Here, "command data" refers to data for instructing the printer to carry out a specific operation. The "pixel data" is data about pixels which compose the image to be printed.

In order to convert the image data that is output from the application program 114 to print data, the printer driver 116 carries out processes such as resolution conversion, color conversion, halftone processing, and rasterization. The following is a description of the processes carried out by the printer driver 116.

Resolution conversion is a process in which image data (text data, picture data, etc.) output from the application program 114 is converted to a resolution for printing on paper. For example, if the resolution for printing an image on paper is designated as 720×720 dpi, then the image data received from the application program 114 is converted to image data of a resolution of 720×720 dpi. It should be noted that, after resolution conversion, the image data becomes multi-gradation RGB data (with, for example, 256 gradations) which is expressed using an RGB color space. Hereafter, RGB data obtained by subjecting image data to resolution conversion processing is referred to as "RGB image data."

Color conversion is a process in which RGB data is converted to CMYK data that is expressed using a CMYK color space. It should be noted that CMYK data is data that corresponds to the ink colors of the printer. Color conversion is carried out by the printer driver 116 referencing a table (a color-conversion look-up table "LUT") in which gradation values of RGB image data are associated with gradation values of CMYK image data. By this color conversion process, RGB data for the pixels is converted to CMYK data that corresponds to each ink color. It should be noted that, after color conversion, the data becomes 256-gradation CMYK data expressed in a CMYK color space. Hereafter, CMYK data obtained by subjecting RGB image data to color conversion is referred to as "CMYK image data."

Halftoning is a process in which data of a high number of gradations is converted to data of a number of gradations that can be formed by the printer. For example, halftone processing converts data which indicates 256 gradations into one-bit data which indicates two gradations or two-bit data which indicates four gradations. Halftoning creates pixel data such that the printer can disperse and form dots using methods such as dithering, gamma correction, and error diffusion. During halftoning, the printer driver 116 references a dither table when performing dithering, references a gamma table when performing gamma correction, and references an error memory for storing diffused errors when performing error diffusion. Data subjected to halftoning has a resolution equivalent to the above-mentioned RGB data (for example, 720×720 dpi). Halftoned data is made from, for example, one-bit or two-bit data for each pixel. Hereafter, in regard to halftoned data, one-bit data is referred to as binary data and two-bit data are referred to as multi-value data.

Rasterization is a process in which image data in a matrix is changed into data suitably ordered for transfer to the printer. Rasterized data is output to the printer as pixel data containing print data.

<Printer Driver Settings>

Figure 7:
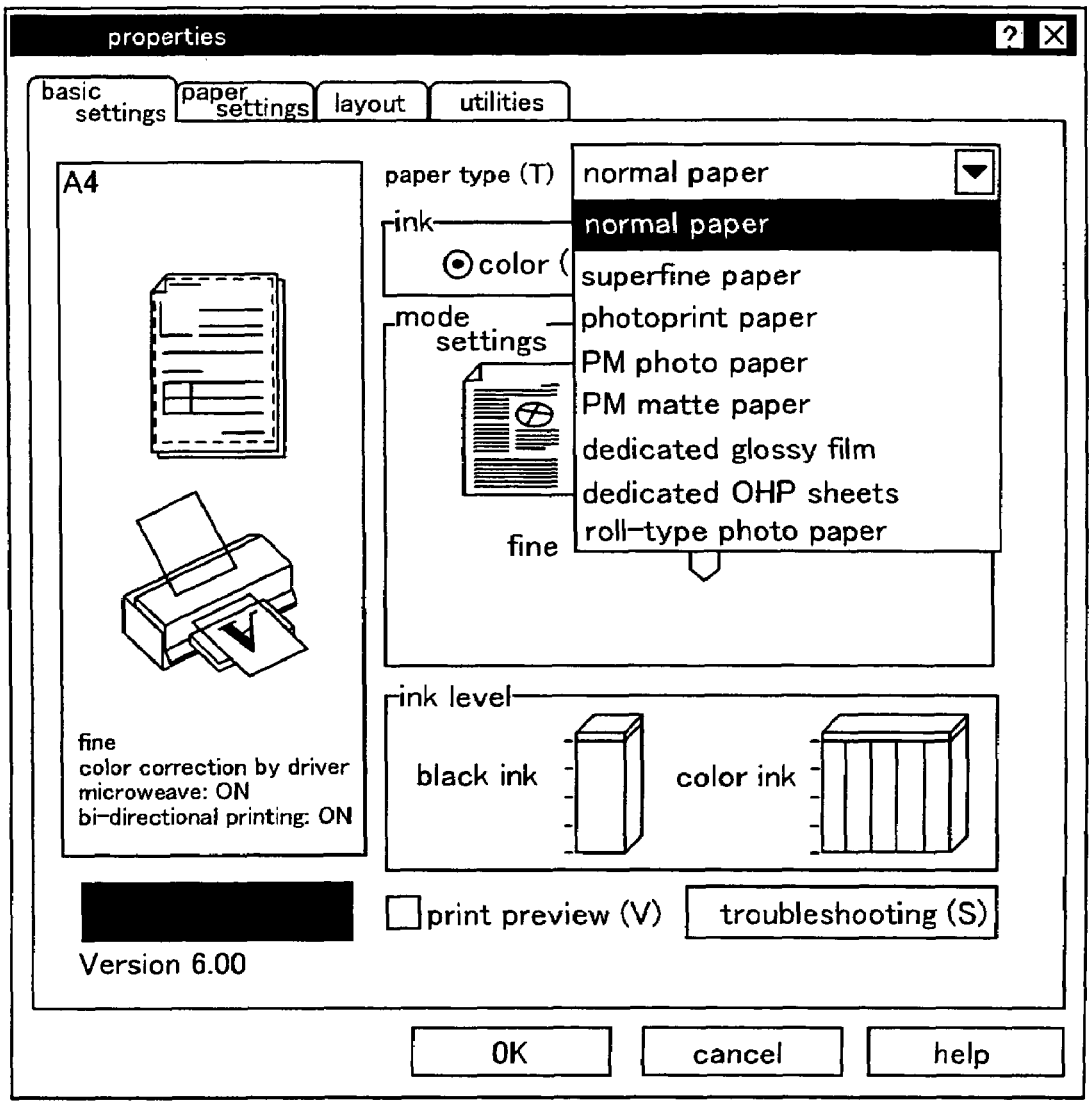
FIG. 7 is an explanatory diagram of a user interface of the printer driver.

FIG. 7 is an explanatory diagram of a user interface of the printer driver. The user interface of the printer driver is displayed on a display device via the video driver 112. The user can use the input device 130 to change the various settings of the printer driver.

The user can select the print mode from this screen. For example, the user can select as the print mode a quick print mode or a fine print mode. The printer driver then converts the image data to print data such that the data is in a format corresponding to the selected print mode.

Furthermore, from this screen, the user can select the print resolution (the dot spacing when printing). For example, the user can select a print resolution of 720 dpi or 360 dpi in this screen. The printer driver then carries out resolution conversion processing in accordance with the selected resolution and converts the image data into print data.

Furthermore, from this screen, the user can select the print paper to be used for printing. For example, the user can select plain paper or glossy paper as the print paper. Since the way ink is absorbed and dries varies depending on the type of paper (paper grade), the amount of ink suitable for printing also varies. For this reason, the printer driver converts image data to print data in accordance with the selected paper type.

In this way, the printer driver converts image data to print data in accordance with conditions that are set via the user interface. It should be noted that, in addition to performing various settings of the printer driver, the user can also be notified from this screen of information such as the amount of ink remaining in the cartridges.

<The Printing Operation>

Figure 8:
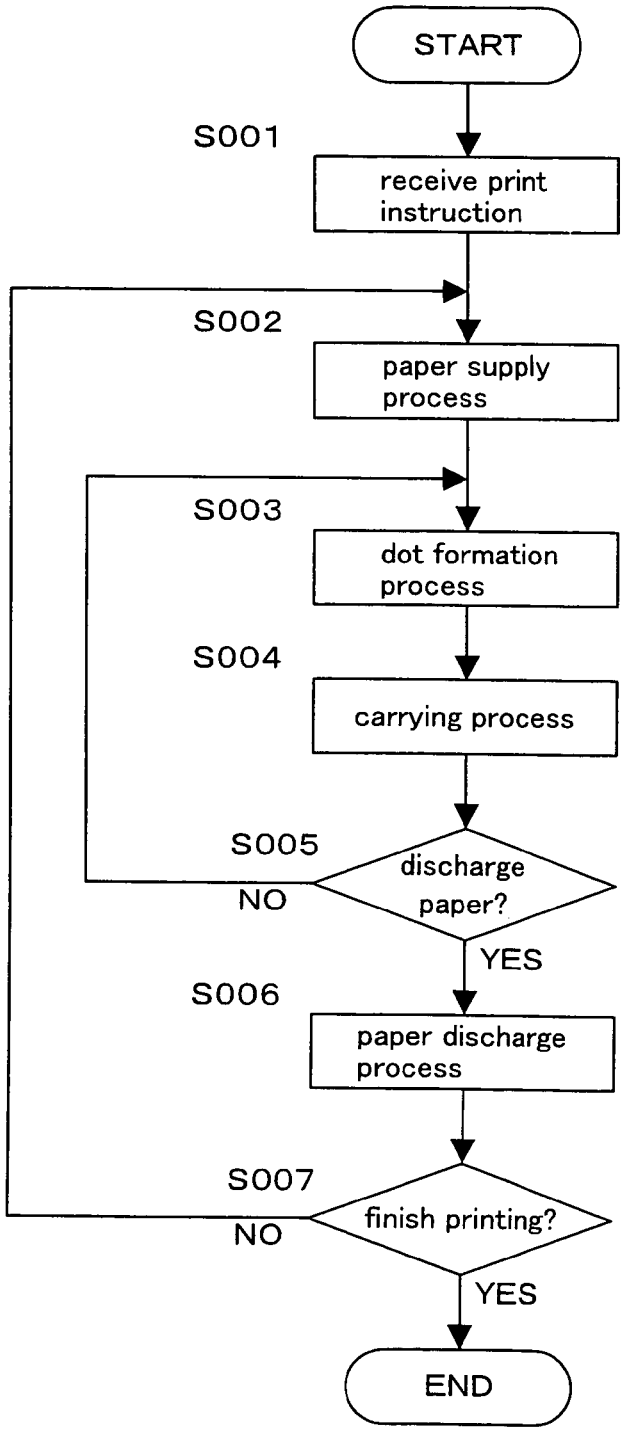
FIG. 8 is a flowchart of the processes during printing.

FIG. 8 is a flowchart of the processes during printing. The processes described below are executed by the printer-side controller 60 controlling the various units in accordance with programs stored in the memory 63. These programs include codes for executing the various processes.

Receive Print Command (S001): First, the printer-side controller 60 receives a print command from the computer 110 via the interface section 61. This print command is included in the header of the print data transmitted from the computer 110. The printer-side controller 60 then analyzes the content of the various commands included in the print data that is received and uses the units to perform the following paper supply process, carrying process, and dot formation process, for example.

Paper Supply Process (S002): The paper supply process is a process for supplying paper to be printed into the printer and positioning the paper at a print start position (also referred to as the "indexed position"). The printer-side controller 60 rotates the paper supply roller 21 to feed the paper to be printed up to the carrying roller 23. Next, the printer-side controller 60 rotates the carrying roller 23 to position the paper, that has been fed from the paper feed roller 21, at the print start position. When the paper has been positioned at the print start position, at least some of the nozzles of the head 41 are in opposition to the paper.

Dot Formation Process (S003): The dot formation process is a process for intermittently ejecting ink from a head that moves in the movement direction so as to form dots on the paper. The printer-side controller 60 drives the carriage motor 32 to move the carriage 31 in the movement direction. The printer-side controller 60 then causes the head to eject ink in accordance with the print data while the carriage 31 is moving. Dots are formed on the paper when ink droplets ejected from the head 41 land on the paper. Since ink is intermittently ejected from the moving head 41, dot rows (raster lines) made of a plurality of dots in the movement direction are formed on the paper.

Carrying Process (S004): The carrying process is a process for moving the paper relative to the head in the carrying direction. The printer-side controller 60 drives the carrying motor to rotate the carrying roller and thereby carry the paper in the carrying direction. Through this carrying process the head 41 can form dots at positions that are different from the positions of the dots formed in the preceding dot formation process.

Paper Discharge Determination (S005): The printer-side controller 60 determines whether or not to discharge the paper being printed. The paper is not discharged if there remains data to print on the paper which is being printed. The printer-side controller 60 repeats in alternation the dot formation and the carrying processes until no data remains to be printed, thus gradually printing an image made of dots on the paper.

Paper Discharge Process (S006): When no data remains for printing on the paper which being printed, the printer-side controller 60 discharges that paper by rotating the paper discharge roller. It should be noted that whether or not to discharge the paper can also be determined based on a paper discharge command included in the print data.

Print Finished Determination (S007): Next, the printer-side controller 60 determines whether or not to continue printing. If the next sheet of paper is to be printed, then printing is continued and the paper supply process for the next sheet of paper is started. If the next sheet of paper is not to be printed, then the printing operation is terminated.

Explanation for Reference

Figure 9:
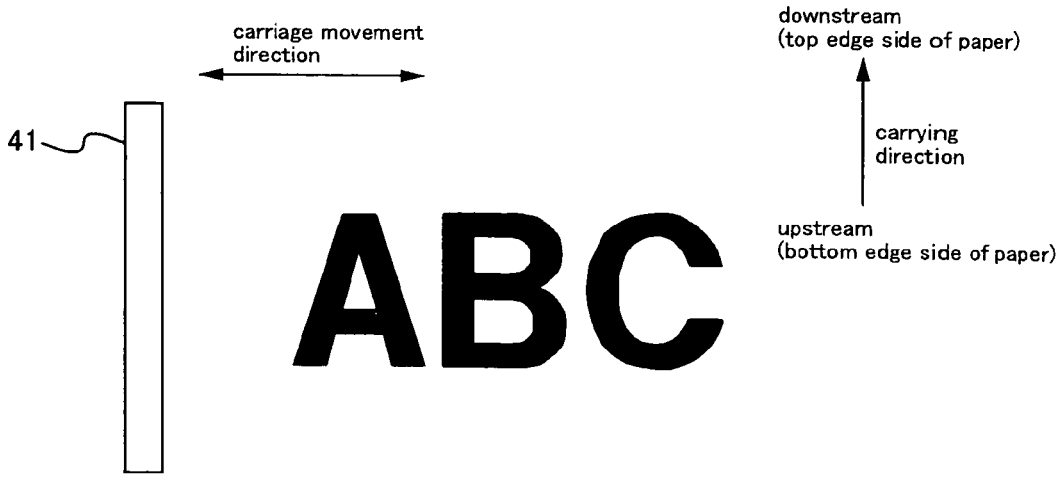
FIG. 9 is an explanatory diagram of a dot formation process.

FIG. 9 is an explanatory diagram of a dot formation process (S003). The rectangle on the left side of the drawing shows the position of the head 41 relative to the paper. The head 41 is provided with a plurality of nozzle groups, but in order to simply the description here, we shall assume that only the black ink nozzle group is provided to the head 41.

During the dot formation process (S003), the printer-side controller 60 causes the head 41 to move in the movement direction (e.g., from left to right in the drawing) in the position shown in the drawing. The printer-side controller 60 then causes ink to be ejected from the head 41 based on the print data, and, as shown in the drawing, prints the image "ABC." Since the nozzle pitch is 1/180 inch, the printed image "ABC" has a resolution of 180 dpi. (Note that the image "ABC" which is printed on the paper is referred to as the "printed image 'ABC'" and the conceptual, data-based image "ABC" is referred to simply as the "image 'ABC.'")

During a single dot formation process, the band-shaped area from the nozzle #1 to the nozzle #180 is the print target area. The length in the carrying direction of the image "ABC" to be printed is shorter than the distance from the nozzle #1 through the nozzle #180 on the head 41. For this reason, the printed image "ABC" is printed on the paper in a single dot formation process.

Figure 10:
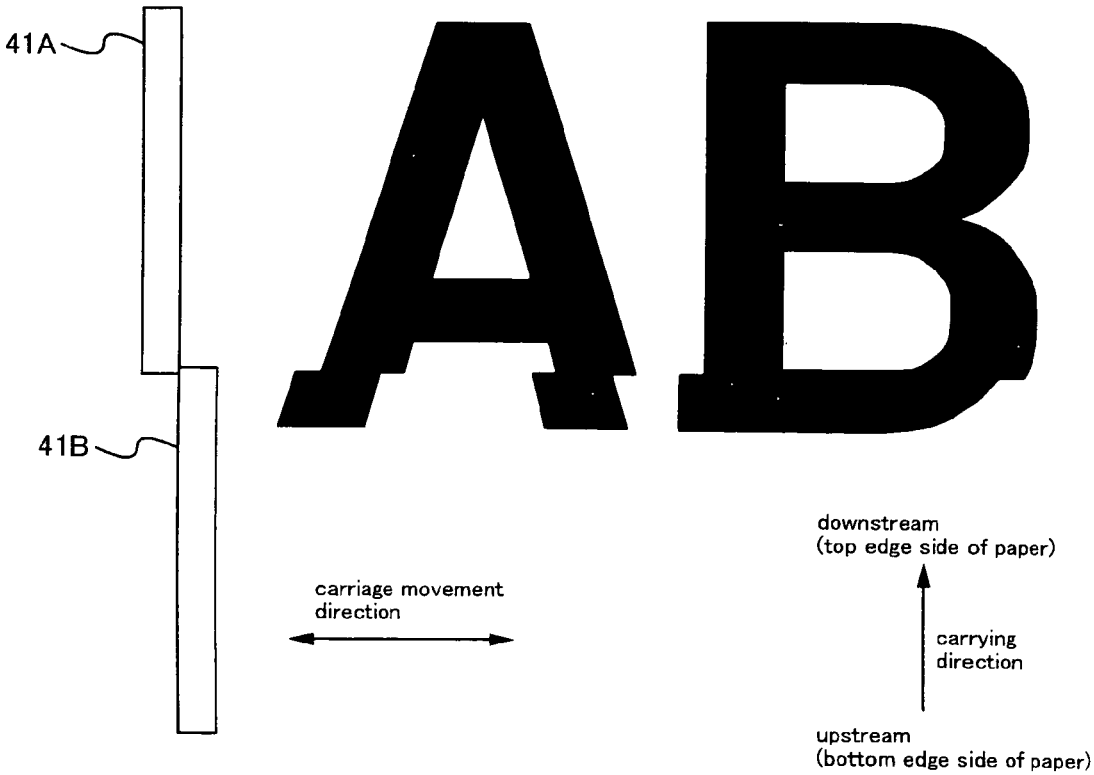
FIG. 10 is an explanatory diagram of how a dot formation process is performed twice.

FIG. 10 is an explanatory diagram of how a dot formation process is performed twice. The rectangle on the left side of the drawing indicates the relative positions of the paper and the head 41 during two dot formation processes. In this drawing, the head 41 is drawn as though moving relative to the paper, but in reality the relative positions of the paper and the head 41 change because the paper is carried relative to the head 41.

The length in the carrying direction of the image "AB" to be printed is longer than the distance from the nozzle #1 through the nozzle #180 on the head 41. Therefore the printer-side controller prints the upper side of the image "AB" in a first dot formation process, carries the paper in the carrying direction with a carrying process, and then prints the remainder of the image in a second dot formation process. In other words, the printed image "AB" is formed through two dot formation processes.

If bi-directional printing is performed, the head 41A moves from left to right in the drawing during the first dot formation process and the head 41B moves from right to left in the drawing during the second dot formation process. Therefore the printed image formed during the second dot formation process is printed offset relative to the printed image formed during the first dot formation process. As a result, a deterioration of the image quality stands out at the seam of the printed images.

(1) Printing Method of First Present Embodiment

<(1) Overview>

Figure 11A:
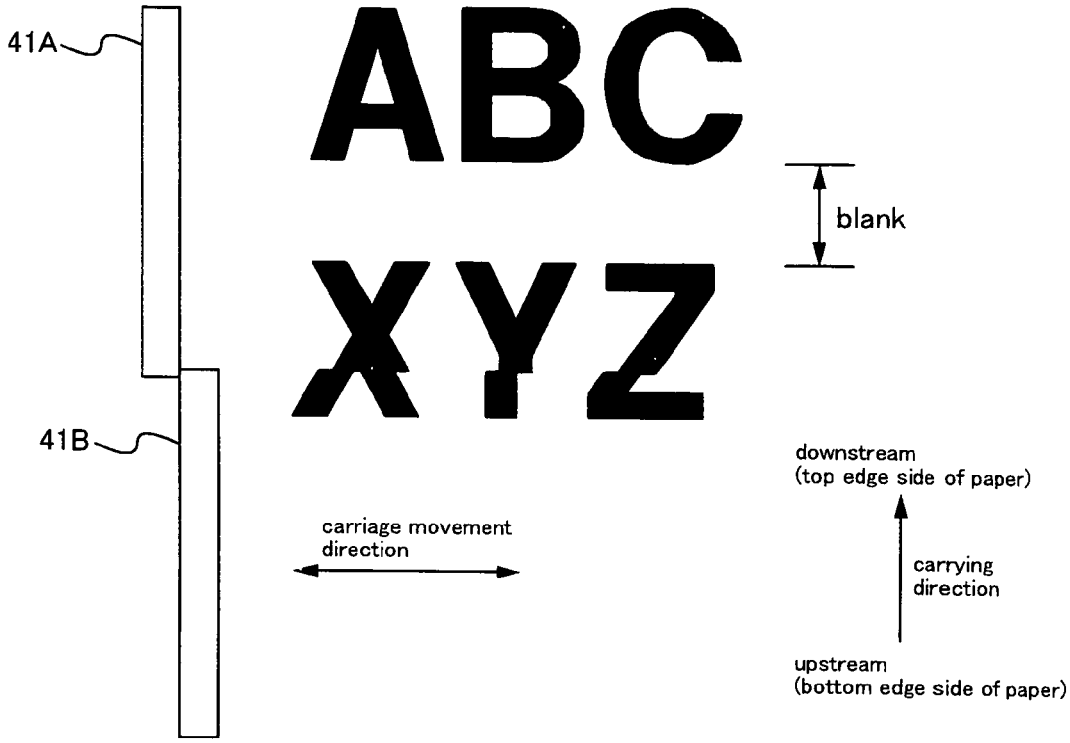
FIG. 11A is an explanatory diagram of a case in which the printing method according to the present embodiment is not executed.
Figure 11B:
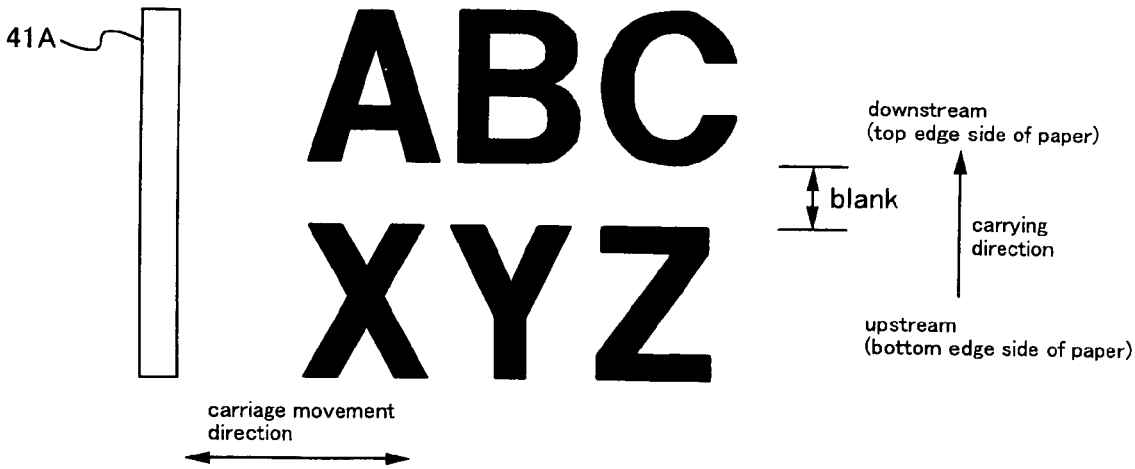
FIG. 11B is an explanatory diagram of a case in which the printing method according to the present embodiment is executed.

FIGS. 11A and 11B are explanatory diagrams of an overview of a printing method according to a first embodiment. FIG. 11A is an explanatory diagram of a case in which the printing method according to the first embodiment is not executed, and FIG. 11B is an explanatory diagram of a case in which the printing method according to the first embodiment is executed.

The length in the carrying direction of the image "ABC XYZ" to be printed is longer than the distance from the nozzle #1 through the nozzle #180 on the head 41. For this reason, in the case in which the printing method of the first embodiment is not executed (FIG. 11A), the deterioration of the image quality stands out.

When printing text documents, however, blanks are often formed between lines. For example, the widths of the blanks are often set at ½ to 2 times the width of the letters. In these explanatory diagrams, too, a blank is formed between the image "ABC" and the image "XYZ."

In the first embodiment, when there is a blank in the image to be printed during a certain dot formation process, the seam in the printed image is eliminated by bringing closer together the image on the upstream side in the carrying direction from the blank (e.g., the image "XYZ") and the image on the downstream side in the carrying direction from the blank (e.g., the image "ABC").

With the first embodiment, it is possible to suppress deterioration of the image quality and cut the printing time per sheet.

<(1) Description 1 of the Printing Method>

Figure 12:
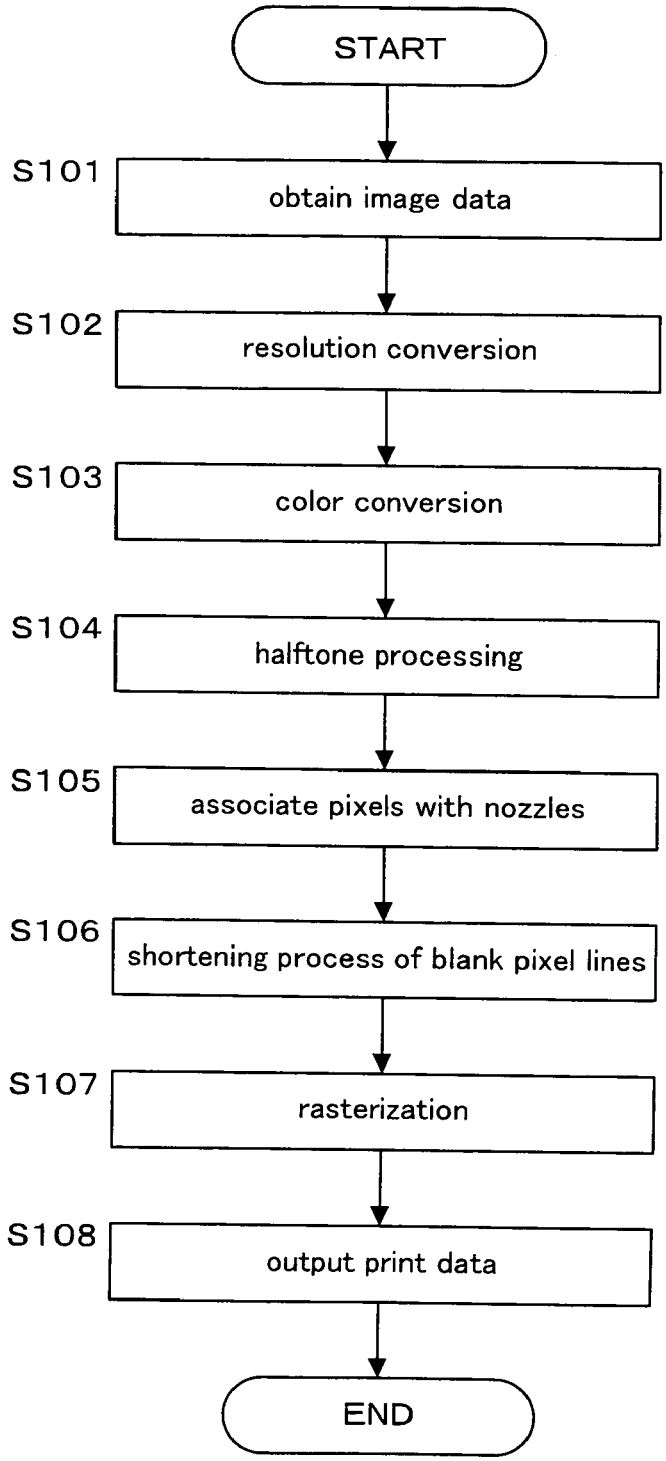
FIG. 12 is a flowchart of the printing method according to the present embodiment.

FIG. 12 is a flowchart of the printing method according to the first embodiment.

Figures 13, 14:
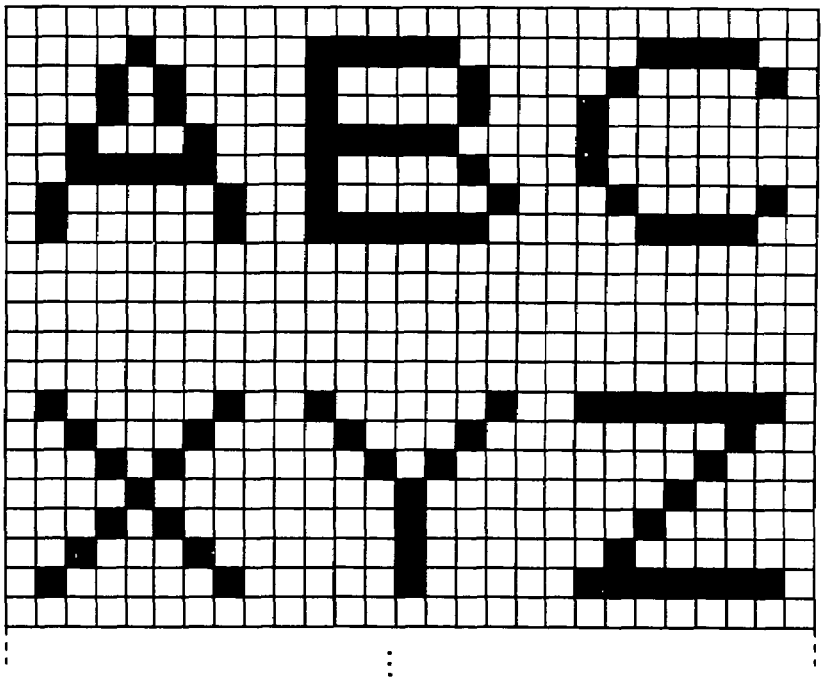
FIG. 13 is an explanatory diagram of the contents of text data.
FIG. 14 is an explanatory diagram of image data after resolution conversion.

First, the printer driver obtains the image data from the application program (S101). If the application program is a document preparation support program, the image data that the printer driver obtains is often text data. In the following description, we shall assume that the printer driver receives image data (text data) showing "ABC XYZ," as indicated in FIG. 13.

Next, the printer driver converts the obtained image data into image data with a resolution of 180×180 dpi (S102). According to the first embodiment, the dot spacing is the same as the nozzle pitch, so the image data after conversion has a resolution of 180×180 dpi. The image data after resolution conversion is shown in FIG. 14. The squares in the drawing indicate pixels. The image "ABC" is made up of seven lines of pixels, and the image "XYZ" is made up of seven lines of pixels. Between the image "ABC" and the image "XYZ" there are five lines of pixels making up a blank. Below the image "XYZ," too, there are pixels which make up a blank line.

Next, the printer driver performs color conversion (S103). The RGB image data which corresponds to the pixels in which text is present (pixels which are filled in with black) is (255, 255, 255), which, when converted to CMYK image data, becomes (0, 0, 0, 255). The RGB image data which corresponds to blank pixels (pixels which are not filled in) is (0, 0, 0), which, when converted to CMYK image data, becomes (0, 0, 0, 0). Hereafter, in order to simplify the description, the description shall be given with attention to the "K" plane.

Next, the printer driver performs halftone processing (S104). Here, the K image data in 256 gradations is converted into binary data with two gradations. If the K image data is "255", it is converted to "1," and if the K image data is "0," it is converted to "0." The halftoned data is shown on the right side of FIG. 15A.

Next, the printer driver associates each pixel with the nozzles (S105). The nozzles associated with each pixel are shown on the left side of FIG. 15A. Note that in order to simplify the description here, we shall assume that the head 41 is provided with only 18 nozzles. As shown in the drawing, the first line of pixels is associated with the nozzle #1 and the second line of pixels is associated with the nozzle #2. The pixels which compose the image "ABC" are associated with the nozzle #2 through the nozzle #8. The pixels which compose the image "XYZ" are associated with the nozzle #14 through the nozzle #18, and the nozzle #1 and the nozzle #2 in the next dot formation process. The five lines of blank pixels between the image "ABC" and the image "XYZ" are associated with the nozzle #9 through the nozzle #13.

Figure 16:
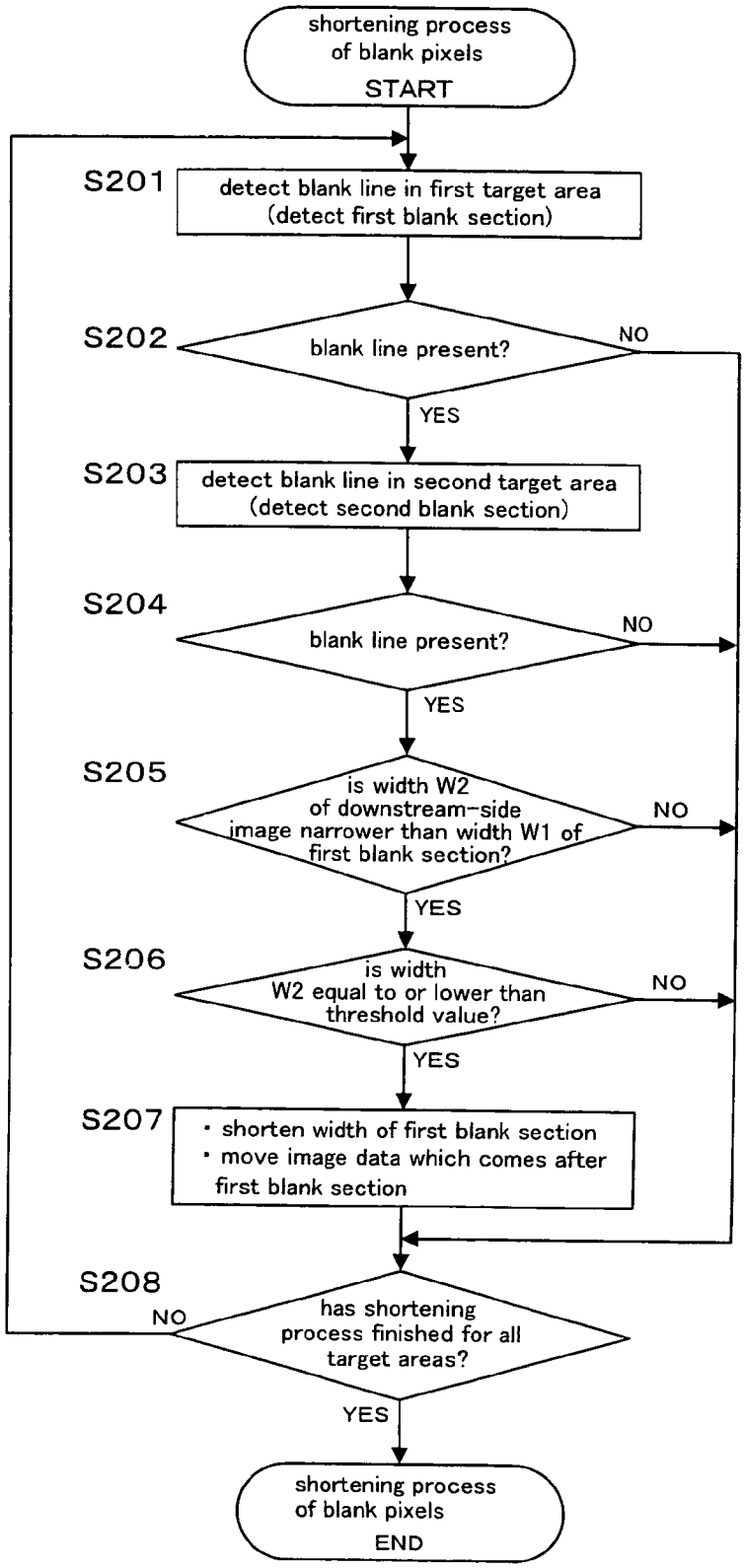
FIG. 16 is a flowchart of processes of shortening blank pixels.

Next, the printer driver performs a shortening process for the blank pixels (S106). FIG. 16 is a flowchart of the process of shortening blank pixels.

The printer driver detects the blank lines in the target area (S201). The target area is the range of pixels which corresponds to a print area which is printed in a single dot formation operation. The first area which is the target is called the "first target area." Detection of blank lines is performed by detecting lines in which the data for all the pixels is "0." The blank lines detected at this time are called the "first blank section." The printer driver determines whether or not blank lines are present (S202), and if there are no blank lines, the shortening process cannot be performed (e.g., as shown in FIG. 10), and the process is terminated (S202: "No").

Figure 15A:
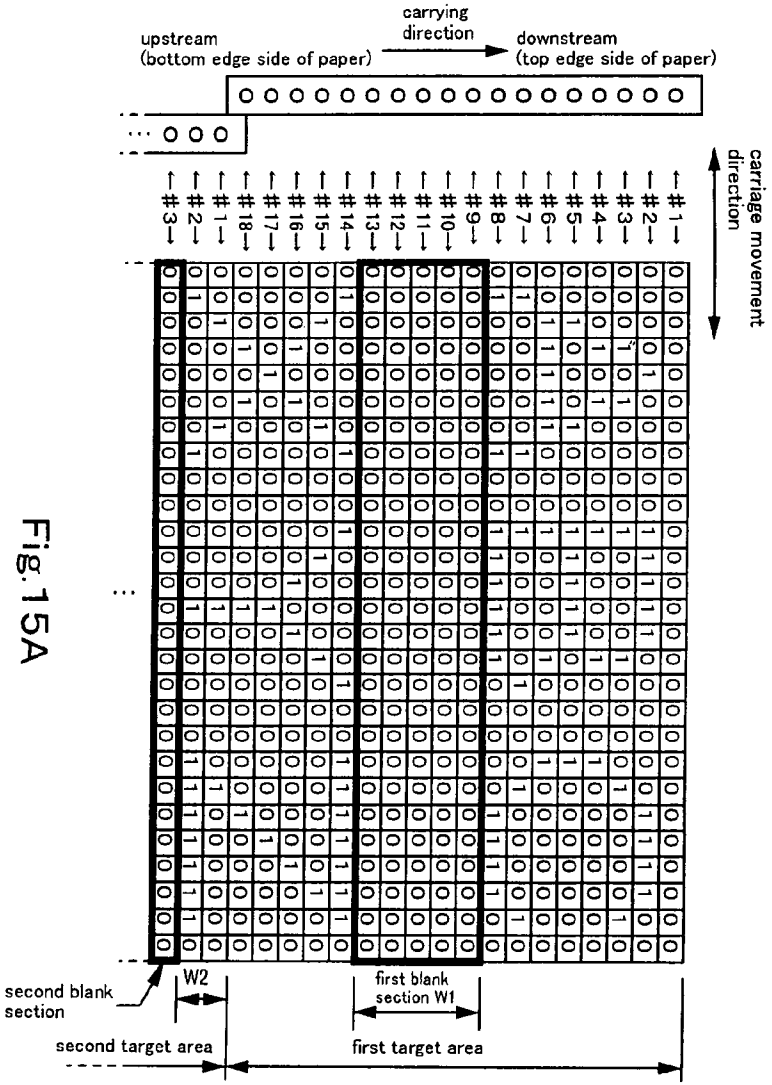
FIG. 15A is an explanatory diagram of data which has undergone halftone processing.

In the first embodiment, the range of the upper 18 lines of pixels in FIG. 15A (the pixels corresponding to the nozzle #1 through the nozzle #18) is the first target area in S201. According to the first embodiment, the five lines of blank lines corresponding to the nozzle #9 through the nozzle #13 in FIG. 15A are detected as the first blank section.

The printer driver detects the blank lines in the next target area (S203). The next target area is the target area corresponding to the next dot formation process following the dot formation process corresponding to S201. This area is called the "second target area." The blank lines detected at this time are called the "second blank section." The printer driver determines whether or not blank lines are present (S204). If there are no blank lines, the shortening process cannot be performed and the process is terminated (S204: "No").

In the first embodiment, the range of pixels in line 19 through line 36 (line 22 and below are not shown) in FIG. 15A are the second target area in S203. According to the first embodiment, the 21$^{st}$ line of pixels corresponding to the nozzle #3 in FIG. 15A is detected as the second blank section.

If the first blank section and the second blank section are detected ("Yes" in both S202 and S204), the printer driver determines whether or not a width W2 of the image downstream from the second blank section, in the image of the second target area, is narrower than a width W1 of the first blank section (S205). Put differently, the printer driver determines whether or not the width W2 of the image which belongs to the second target area, of the image between the first blank section and the second blank section, is narrower than the width W1 of the first blank section. In other words, the printer driver determines whether or not the width W2 of a non-blank section which protrudes out of the second target area from the first target area is narrower than the first blank section.

If the determination in S205 is "No," then the shortening process is not performed and the process is terminated. If the first blank section were to be shortened when the determination at S205 is "No," no advantages such as improvement of image quality or reduction of printing time are achieved, but this will only give rise to a drawback of a printed image different from the original image being formed.

According to the first embodiment, the bottom portion of the image "XYZ" (the portion on the upstream side in the carrying direction) corresponds to the image on the downstream side from the second blank section of the image in the second target area. The width of this image is two lines. The first blank section, on the other hand, is five lines. For this reason, the determination in S205 is "Yes."

If the determination in S205 is "Yes," then it is determined whether or not the width W2 is equal to or smaller than a predetermined threshold (S206). If the width W2 is larger, then, as described below, the first blank section is shortened equal in amount to the width W2, and the difference between the original image and the printed image grows larger. Therefore, if the width W2 is larger than the threshold (S206: "No"), the shortening process is not performed and the process is terminated. According to the first embodiment, the threshold is set at five lines. Since the width W2 is two lines, the determination in S206 is "Yes." The threshold is not a fixed value, but may be set to half of the first blank section.

If the determination in S206 is "Yes," the printer driver shortens the width of the first blank section and moves the image which is upstream in the carrying direction from the first blank section (the image below the first blank section in the drawing) downstream in the carrying direction (S207). (Specifically, the printer driver rearranges the order of the image data.) The width of the first blank section is shortened by the width equal to W2. As a result, the pixels which correspond to the image between the first blank section and the second blank section are all contained in the first target area.

Figure 15B:
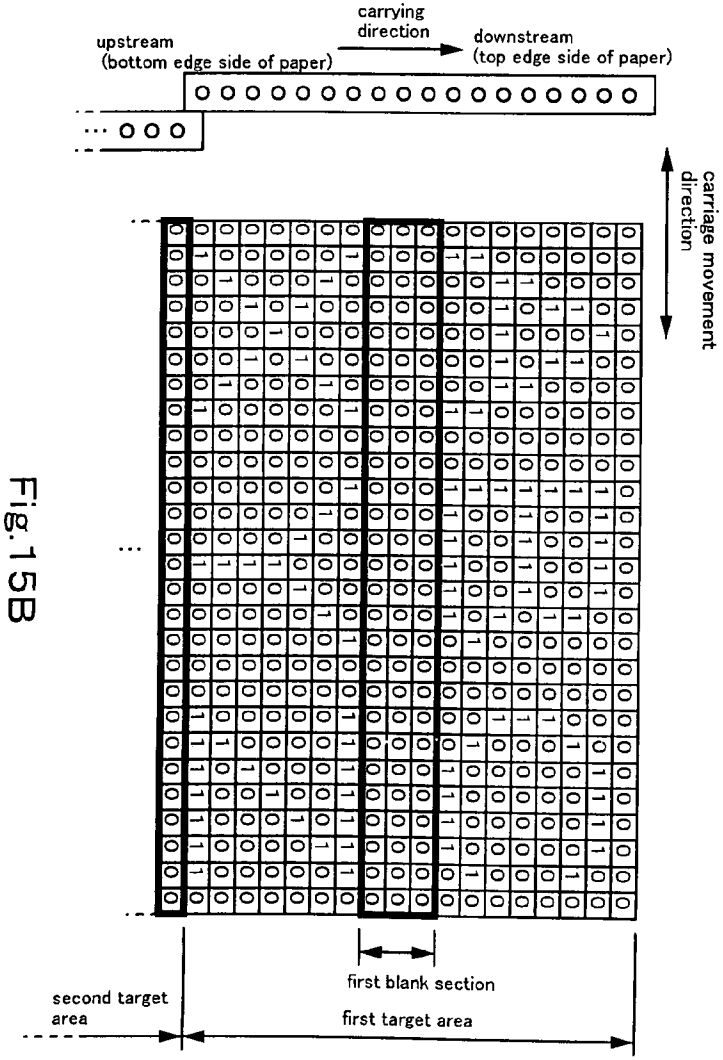
FIG. 15B is an explanatory diagram of data after a shortening process has been performed.

FIG. 15B shows the image data which has undergone the shortening process according to the first embodiment. According to the first embodiment, the first blank section is shortened by only two lines. The image "XYZ" upstream in the carrying direction from the first blank section moves downstream in the carrying direction closer to the image "ABC." As a result, the pixels corresponding to the image "XYZ" are all contained in the first target area.

The printer driver repeats a similar shortening procedure for the target areas corresponding to each dot formation process (S201 through S208). When the shortening process for all the target areas is finished (S208: "Yes"), then the shortening process for the blank pixels is ended and the process moves to step S107 in FIG. 12.

The printer driver performs a rasterization process based on the image data which has undergone the shortening process (S107). The printer driver then outputs the print data to the printer (S108) and the printer prints according to the print data.

Figure 17:
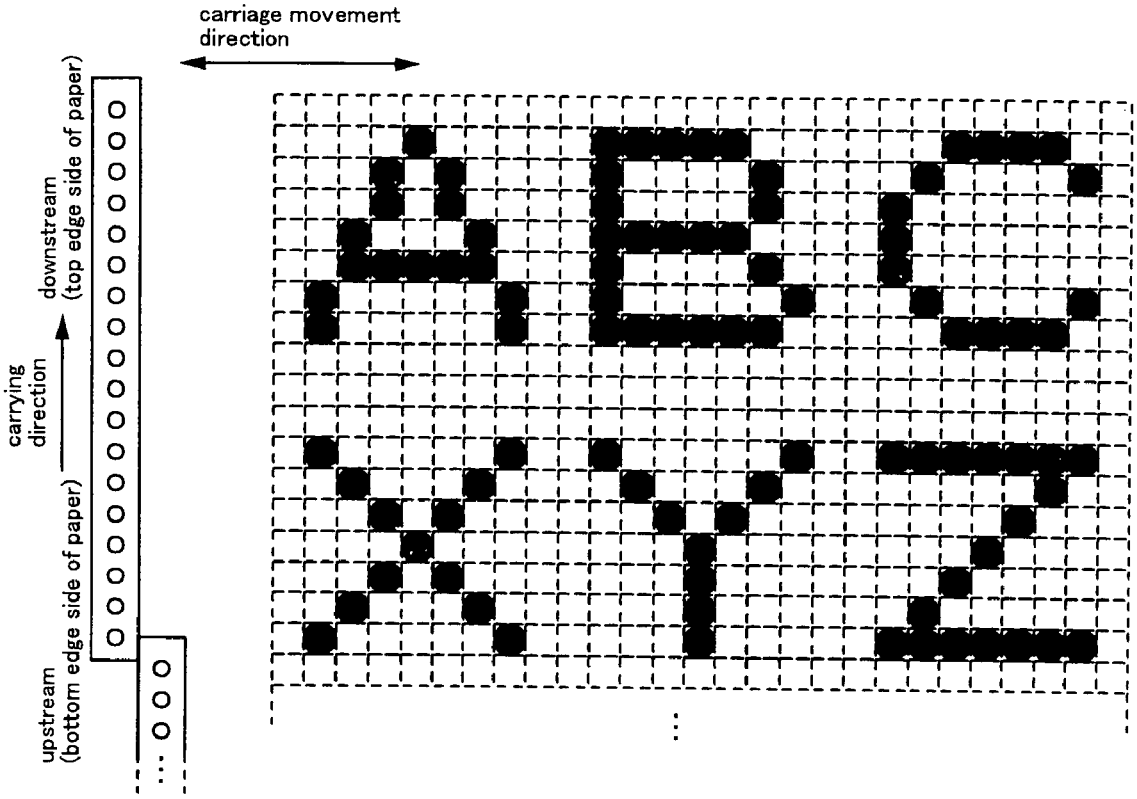
FIG. 17 is an explanatory diagram of the results of printing according to the present embodiment.

FIG. 17 is an explanatory diagram of the results of printing according to the first embodiment. If the pixel data is "0," ink is not ejected from the nozzles, and if the pixel data is "1," ink is ejected from the nozzles. As a result, dots are formed at positions on the paper corresponding to the pixels for which the pixel data is "1." A row of dots is formed by each nozzle ejecting ink droplets while moving during the dot formation process. For example, the nozzle #2 forms a dot row which is made up of ten dots. As each nozzle forms a dot row, the printed image "ABC XYZ" is composed.

According to the first embodiment, the printed image "XYZ" is printed by the first dot formation operation. For this reason, there is no seam in the printed image "XYZ" and the image quality does not deteriorate. Further, compared to a case in which two dot formation operations are used, the printing time is shorter.

<(1) Description 2 of the Printing Method>

There may be a plurality of the first blank section. The plurality of the first blank section may each be shortened.

Figure 18:
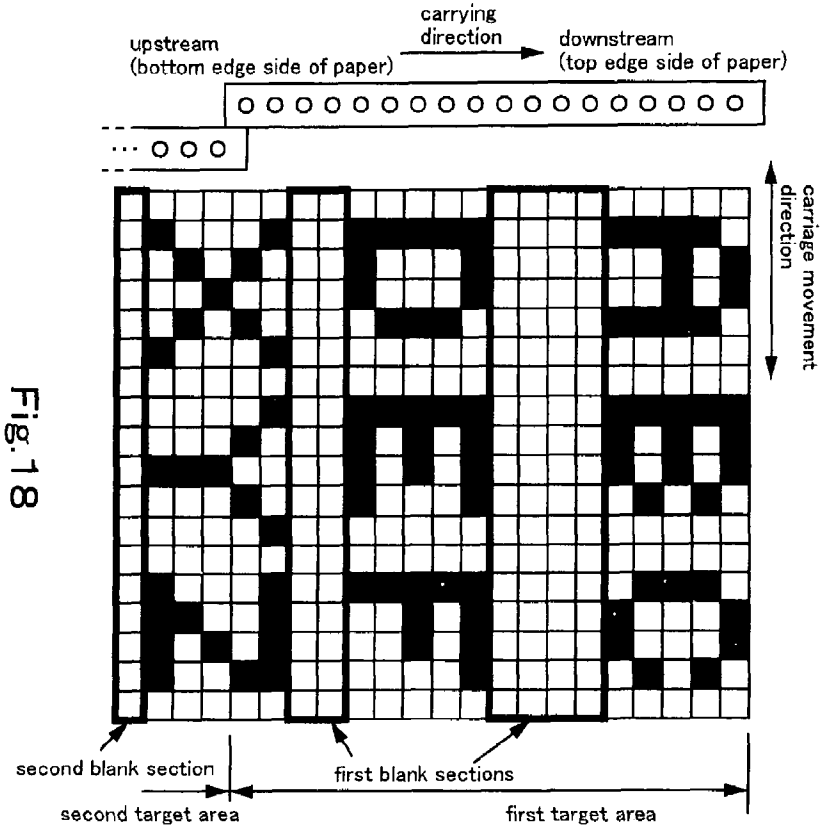
FIG. 18 is an explanatory diagram of image data after resolution conversion.

FIG. 18 shows image data of an image "ABC DEF XYZ" after resolution conversion. There is a first blank section made up of two blank sections in the first target area. Of the two blank sections, the upper (downstream in the carrying direction) blank section is a blank section of four lines between the image "ABC" and the image "DEF." The other blank section is a blank section of two lines between the image "DEF" and the image "XYZ." There is a second blank section in the second target area, too, below (upstream in the carrying direction) the image (XYZ). The bottom portion (the portion upstream in the carrying direction) of the image "XYZ" is contained in the second target area. The width of this portion is three lines. In order to print the image "ABC DEF XYZ" on the paper in one dot formation process, the first blank section needs to be shortened by three lines.

In this case, the blank section of four lines in the first blank section could be shortened to one line to form the image "ABC DEF XYZ" in one dot formation process. However, forming the image in this way causes the printed image "DEF" to move closer to the printed image "ABC" than in the original image.

Therefore, in the present embodiment, the printer driver determines the shortening width for each blank section in accordance with the ratio of the widths of each blank section. Specifically, the printer driver shortens the blank section of four lines (the upper blank section) by two lines and then shortens the blank section of two lines (the lower blank section) by one line, when shortening the first blank section by three lines.

Figure 19:
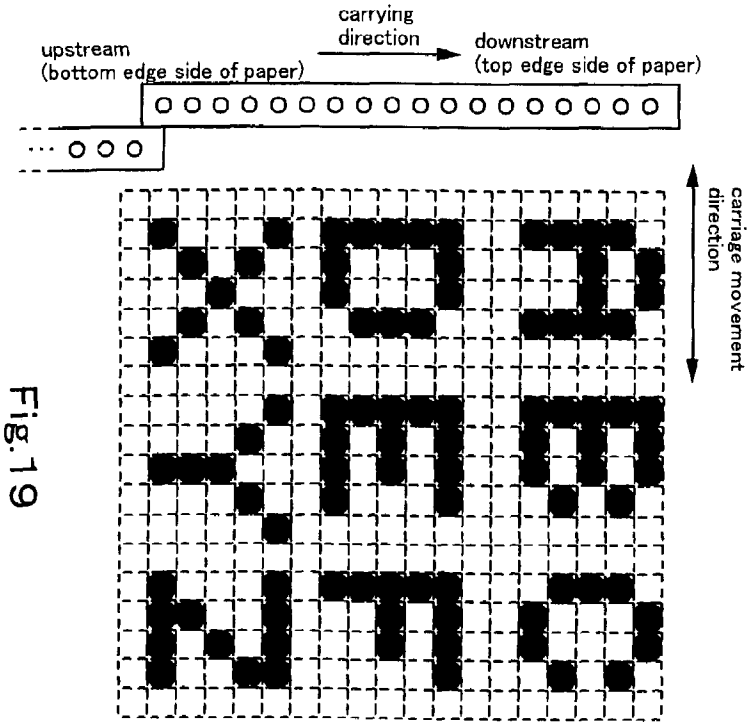
FIG. 19 is an explanatory diagram of another printing result.

FIG. 19 is an explanatory diagram of the results of printing according to the present embodiment. As described above, the printed image "XYZ" is printed in one dot formation operation. For this reason, the same effects are achieved as described above.

In addition, the printed image "DEF" is closer to the printed image "XYZ," as in the original image. Since the printer driver determines the shortening width of the blank sections according to the width of the blank sections as described above, it becomes possible to achieve a printed image similar to that of the original image.

<(1) The Shortening Process>

In the embodiment described above, the printer driver performed the shortening process (specifically, the computer in which the printer driver is installed). However, the printer itself may perform the shortening process. In this case, the printer-side controller 60 of the printer analyzes the print data received from the printer driver according to the programs stored in the memory 63, and performs the shortening process by rearranging the pixel data in the print data as needed. In a case in which the printer performs the shortening process like this, the printer itself becomes the printing system.

(2) Printing Method of Second Present Embodiment

<(2) Reference Example>

Figure 20A:
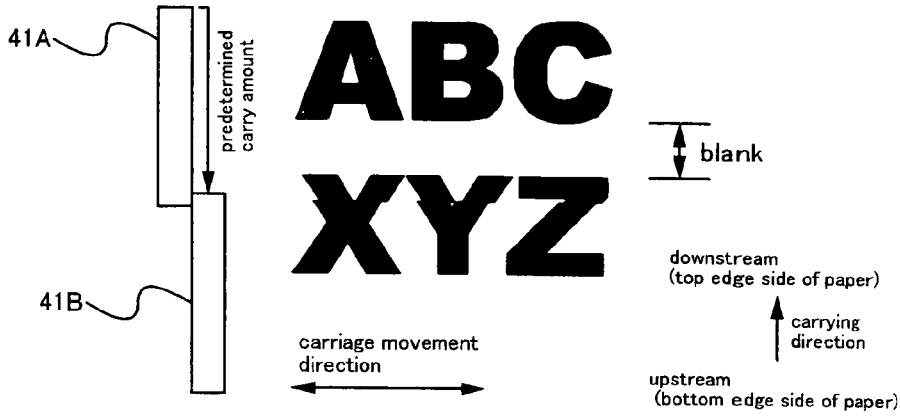
FIG. 20A is an explanatory diagram of an ordinary case.

FIG. 20A is an explanatory diagram of a case in which an ordinary printing method is executed.

In the case of an ordinary printing method, a printed image "ABC" and the upper side of a printed image "XYZ" is printed in a first dot formation operation and the lower side of the printed image "XYZ" is printed during a second dot formation operation. In other words, the printed image "XYZ" is formed through two dot formation processes. Therefore, deterioration of the image quality stands out in the seam of the printed image "XYZ".

Figure 20B:
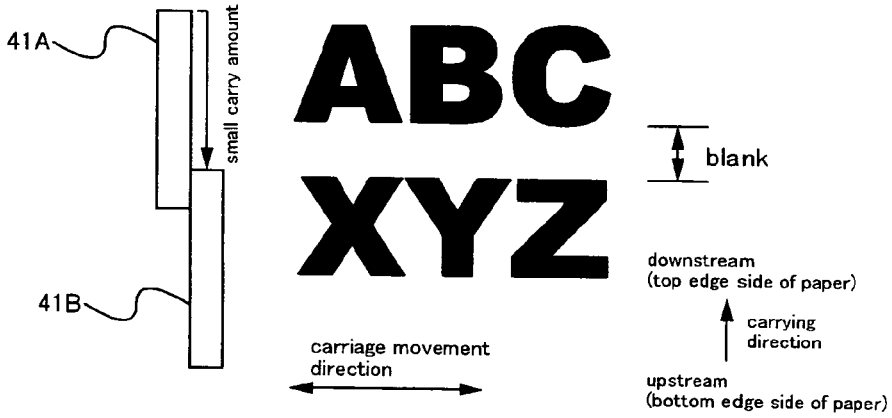
FIG. 20B is an explanatory diagram of the case of the reference example.

FIG. 20B is an explanatory diagram of a case in which the printing method according to the reference example is executed.

When printing text documents, blanks are often formed between lines. For example, the widths of the blanks are often set at ½ to 2 times the width of the letters. In these explanatory diagrams, too, a blank is formed between the image "ABC" and the image "XYZ."

With the printing method of the reference example, first the image downstream in the carrying direction from the blank (here, the image "ABC") is printed, the paper is carried by a carry amount smaller than the predetermined carry amount, and the image upstream in the carrying direction from the blank (here, the image "XYZ") is printed in the next dot formation process. With the printing method according to the reference example, the seam of the printed image is eliminated and deterioration of the image quality is suppressed.

However, with the printing method of the reference example, printing is performed by changing the carry amount halfway through. (The fact that the carry amount in the reference example is smaller than the ordinary carry amount can be seen from the fact that the distance from the head 41A to the head 41B in FIG. 20B is shorter than the distance from the head 41A to the head 41B in the FIG. 20A.) By changing the carry amount halfway through in this manner, the carrying process cannot be performed in a stable manner, as the amount of offset in the carry amount changes during every carrying process. For this reason, there is demand for a carrying process which can be performed at a fixed carry amount during printing.

<(2) Overview of the Second Embodiment>

Figure 20C:
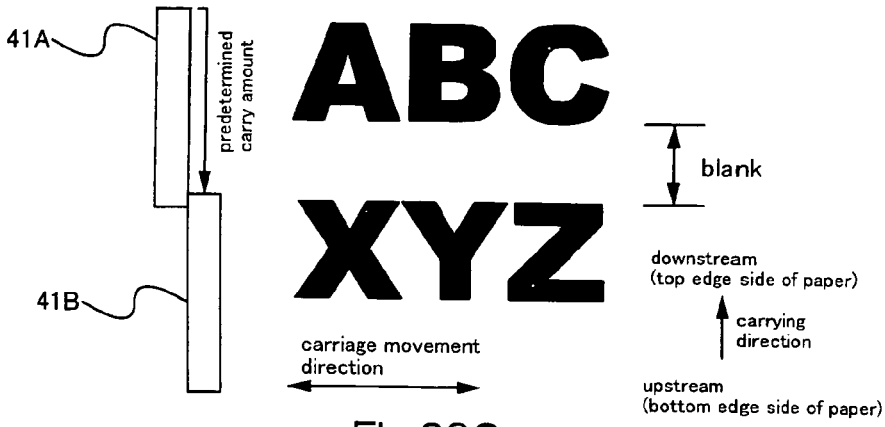
FIG. 20C is an explanatory diagram of a case in which the printing method according to the present embodiment is executed.

FIG. 20C is an explanatory diagram of a case in which the printing method according to a second embodiment is executed.

With the second embodiment, when there is a blank in the image to be printed during a certain dot formation process, this blank is expanded, the image downstream in the carrying direction from the blank (here, the image "ABC") is printed, the paper is carried by the predetermined carry amount, and the image upstream in the carrying direction from the blank (here, the image "XYZ") is printed in the next dot formation process.

With the second embodiment, it is possible to eliminate seams in the printed image and perform printing at a constant carry amount.

<(2) Description of the Printing Method of the Second Embodiment>

Figure 21:
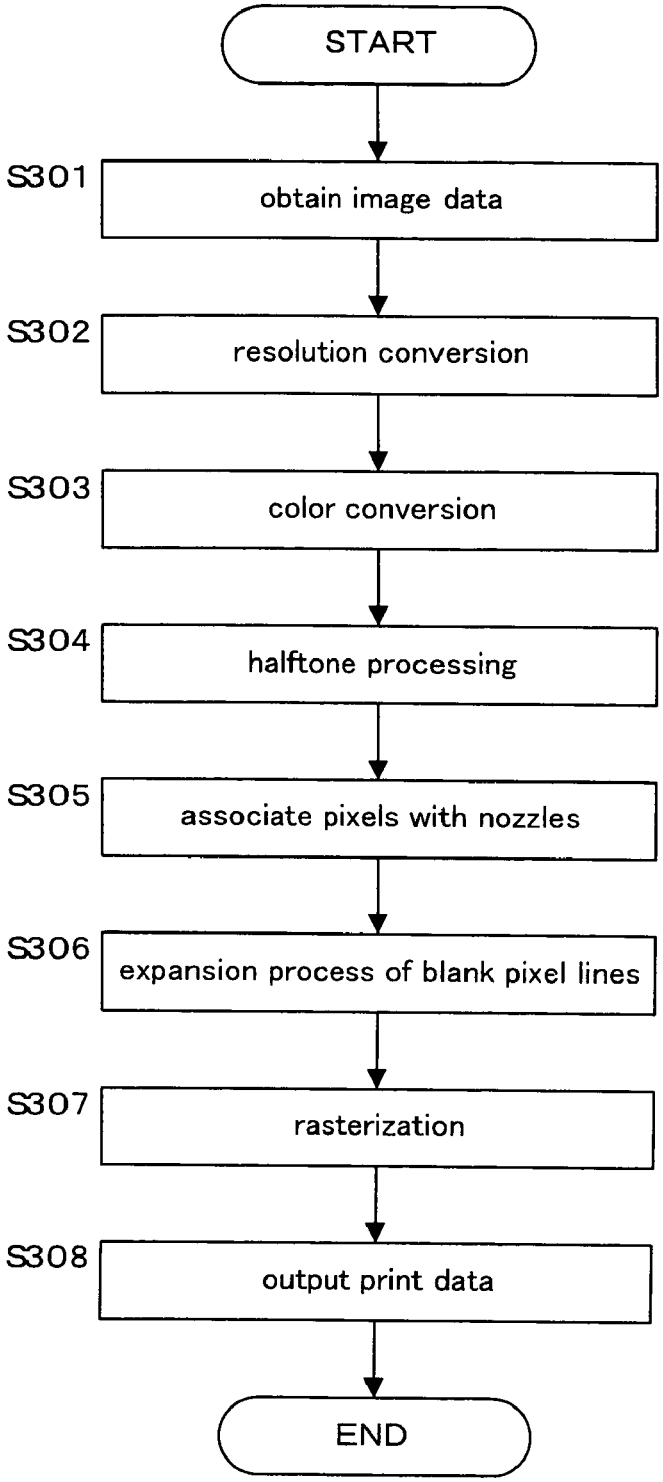
FIG. 21 is a flowchart of the printing method according to the present embodiment.

FIG. 21 is a flowchart of the printing method according to the second embodiment.

Figures 22, 23:
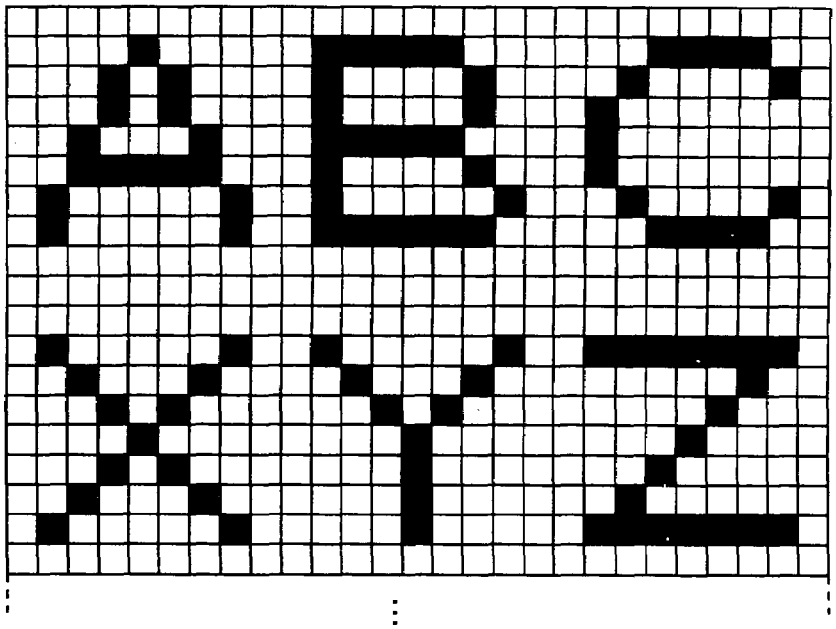
FIG. 22 is an explanatory diagram of the contents of text data.
FIG. 23 is an explanatory diagram of image data after resolution conversion.

First, the printer driver obtains the image data from the application program (S301). If the application program is a document preparation support program, the image data that the printer driver obtains is often text data. In the following description, we shall assume that the printer driver receives image data (text data) showing the image "ABC XYZ," as indicated in FIG. 22.

Next, the printer driver converts the obtained image data into image data with a resolution of 180×180 dpi (S302). According to the second embodiment, the dot spacing is the same as the nozzle pitch, so the image data after conversion has a resolution of 180×180 dpi. The image data after resolution conversion is shown in FIG. 23. The squares in the drawing indicate pixels. The image "ABC" is made up of seven lines of pixels, and the image "XYZ" is made up of seven lines of pixels. Between the image "ABC" and the image "XYZ" there are three lines of pixels making up a blank. Below the image "XYZ," too, there are pixels which make up a blank line.

Next, the printer driver performs color conversion (S303). The RGB image data which corresponds to the pixels in which text is present (pixels which are filled in with black) is (255, 255, 255), which, when converted to CMYK image data, becomes (0, 0, 0, 255). The RGB image data which corresponds to blank pixels (pixels which are not filled in) is (0, 0, 0), which, when converted to CMYK image data, becomes (0, 0, 0, 0). Hereafter, in order to simplify the description, the description shall be given with attention to the "K" plane.

Next, the printer driver performs halftone processing (S304). Here, the K image data in 256 gradations is converted into binary data with two gradations. If the K image data is "255", it is converted to "1," and if the K image data is "0," it is converted to "0." The halftoned data is shown on the right side of FIG. 24A.

Next, the printer driver associates each pixel with the nozzles (S305). The nozzles associated with each pixel are shown on the left side of FIG. 24A. Note that in order to simplify the description here, we shall assume that the head 41 is provided with 13 nozzles. (The number of the nozzles differs from that in the first embodiment for convenience.) As shown in the drawing, the first line of pixels is associated with the nozzle #1 and the second line of pixels is associated with the nozzle #2. The pixels which compose the image "ABC" are associated with the nozzle #2 through the nozzle #8. The pixels which compose the image "XYZ" are associated with the nozzle #12 and the nozzle #13, and the nozzle #1 through the nozzle #5 in the next dot formation process. The three lines of blank pixels between the image "ABC" and the image "XYZ" are associated with the nozzle #9 through the nozzle #11.

Figure 25:
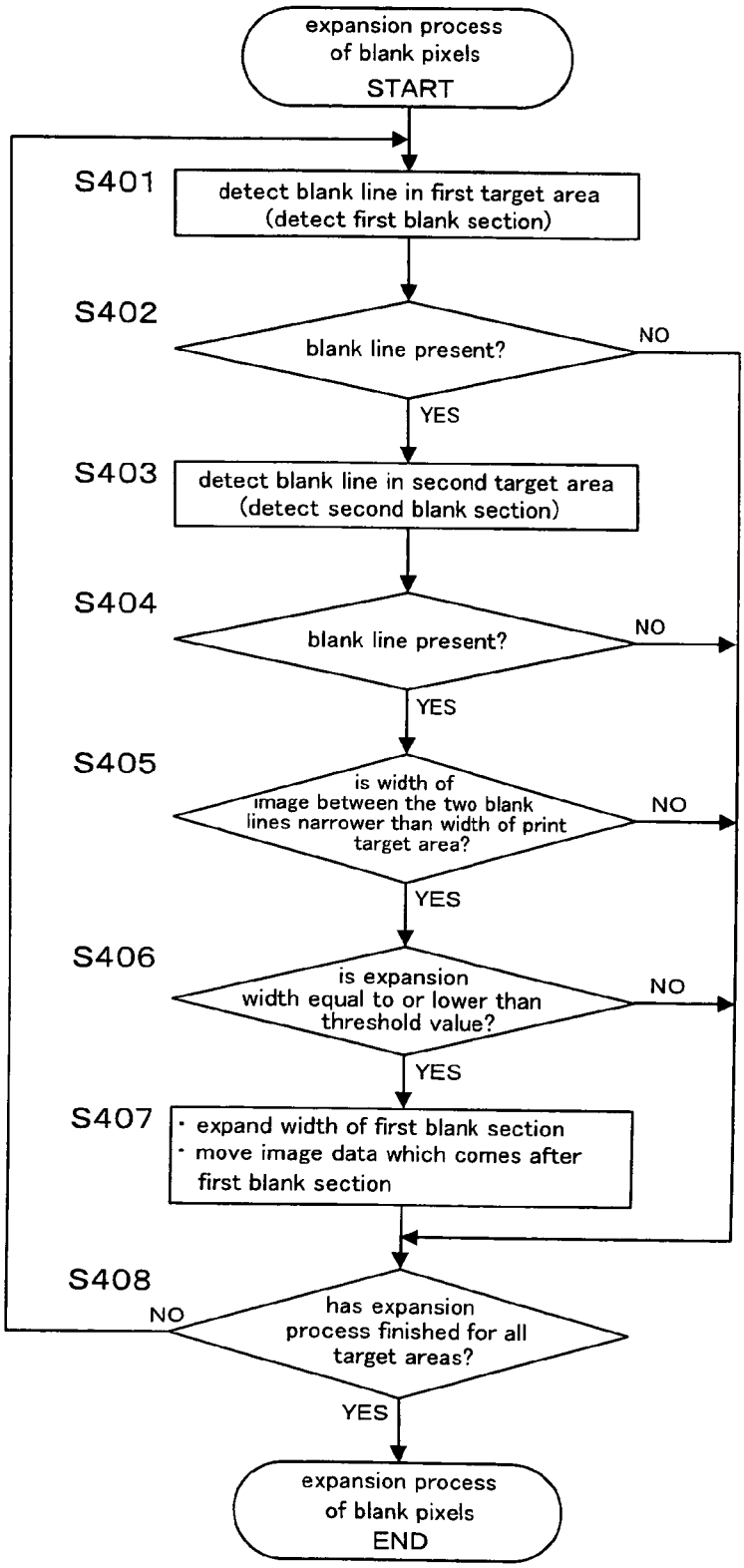
FIG. 25 is a flowchart of processes of expanding blank pixels.

Next, the printer driver performs an expansion process for the blank pixels (S306). FIG. 25 is a flowchart of the process of expanding blank pixels.

The printer driver detects the blank lines in the target area (S401). The target area is the range of pixels which corresponds to a print area which is printed in a single dot formation operation. The first area which is the target is called the "first target area." Detection of blank lines is performed by detecting lines in which the data for all the pixels is "0." The blank lines detected at this time are called the "first blank section." The printer driver determines whether or not blank lines are present (S402), and if there are no blank lines, the expansion process cannot be performed (e.g., as shown in FIG. 10), and the process is terminated (S402: "No").

Figure 24A:
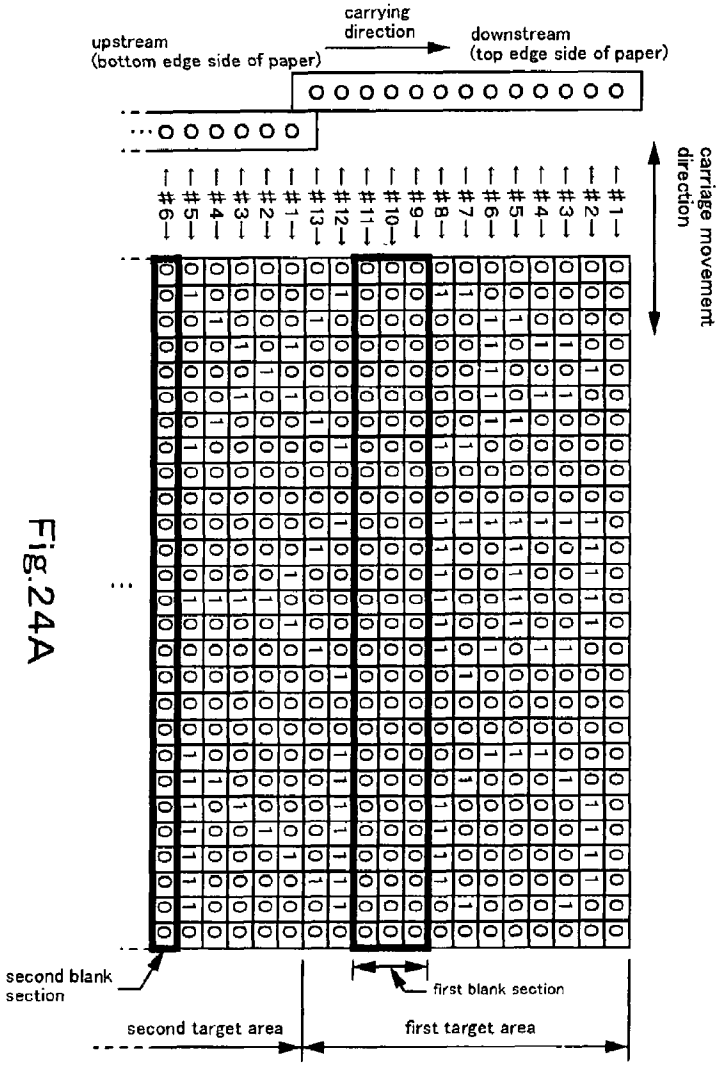
FIG. 24A is an explanatory diagram of data which has undergone halftone processing.

In the second embodiment, the range of the upper 13 lines of pixels in FIG. 24A (the pixels corresponding to the nozzle #1 through the nozzle #13) is the first target area in S401. According to the second embodiment, the three lines of blank lines corresponding to the nozzle #9 through the nozzle #11 in FIG. 24A are detected as the first blank section.

The printer driver detects the blank lines in the next target area (S403). The next target area is the target area corresponding to the next dot formation process following the dot formation process corresponding to S401. This area is called the "second target area." The blank lines detected at this time are called the "second blank section." The printer driver determines whether or not blank lines are present (S404), and if there are no blank lines, the expansion process cannot be performed, and the process is terminated (S404: "No").

In the second embodiment, the range of pixels in line 14 through line 26 (line 19 and below are not shown) in FIG. 24A are the second target area in S403. According to the second embodiment, the $19^{th}$ line of pixels corresponding to the nozzle #6 in FIG. 24A is detected as the second blank section.

If the first blank section and the second blank section are detected ("Yes" in both S402 and S404), the printer driver determines whether or not the width of the image between the two blank sections is narrower than the width of the target area (the width of the print area to be printed in during one dot formation process) (S405).

If the determination in S405 is "No," then the expansion process is not performed and the process is terminated. If the first blank section were to be expanded when the determination in S405 is "No," printing the image downstream of the first blank section will always result in a seam being created, and this will only give rise to a drawback of a printed image different from the original image being formed and the image quality being impossible to improve.

In the second embodiment, the image "XYZ" corresponds to the image between the two blank sections. The width of the image "XYZ" is seven lines. The width of the target area is thirteen lines. For this reason, the determination in S405 is "Yes."

If the determination in S405 is "Yes," then it is determined whether or not the expanded width of the blank section is equal to or smaller than a predetermined threshold (S406). The expanded width is the width of the image upstream in the carrying direction from the first blank section in the first target area. In other words, the expanded width is the width of the image belonging to the first target area in the image between the first blank section and the second blank section. If the expanded width of the blank section is larger, then the first blank section will be expanded as described below, and the difference between the original image and the printed image grows larger. Therefore, if the expanded width of the blank section is larger than the threshold (S406: "No"), the expansion process is not performed and the process is terminated. According to the second embodiment, the threshold is set at four lines. Since the expanded width of the blank section is two lines, the determination in S406 is "Yes." The threshold is not a fixed value, but may be set to half of the first blank section.

If the determination in S406 is "Yes," the printer driver expands the width of the first blank section and moves the image which is upstream in the carrying direction from the first blank section (the image below the first blank section in the drawing) upstream in the carrying direction (S407). (Specifically, the printer driver rearranges the order of the image data.) The width of the first blank section is expanded by the expansion width. As a result, the pixels which correspond to the image between the first blank section and the second blank section are all contained in the first target area.

Figure 24B:
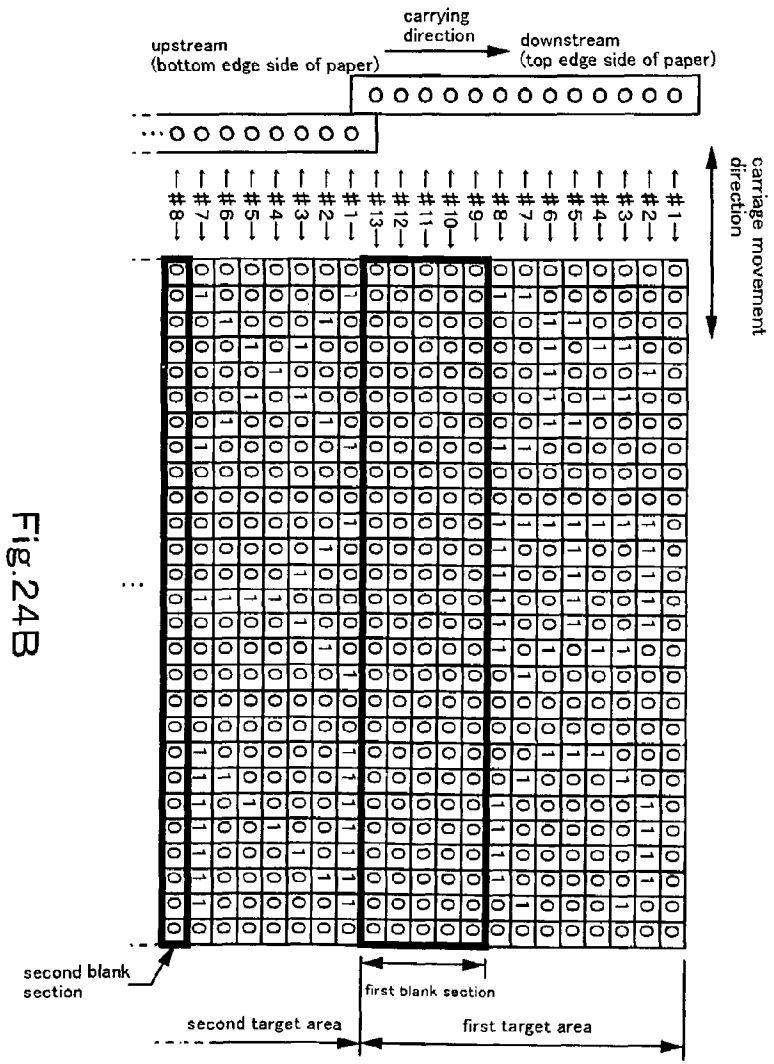
FIG. 24B is an explanatory diagram of data after an expansion process has been performed.

FIG. 24B shows the image data which has undergone the expansion process according to the second embodiment. According to the second embodiment, the first blank section is expanded by only two lines. The image "XYZ" upstream in the carrying direction from the first blank section is moved upstream in the carrying direction away from the image "ABC." As a result, the pixels corresponding to the image "XYZ" are all contained in the second target area, and no longer contained in the first target area.

The printer driver repeats a similar expansion procedure for the target areas corresponding to each dot formation process (S401 through S408). When the expansion process for all the target areas is finished (S408: "Yes"), the expansion process for the blank pixels is ended and the process moves to step S307 in FIG. 21.

The printer driver performs a rasterization process based on the image data which has undergone the expansion process (S307). The printer driver then outputs the print data to the printer (S308) and the printer prints according to the print data.

Figure 26:
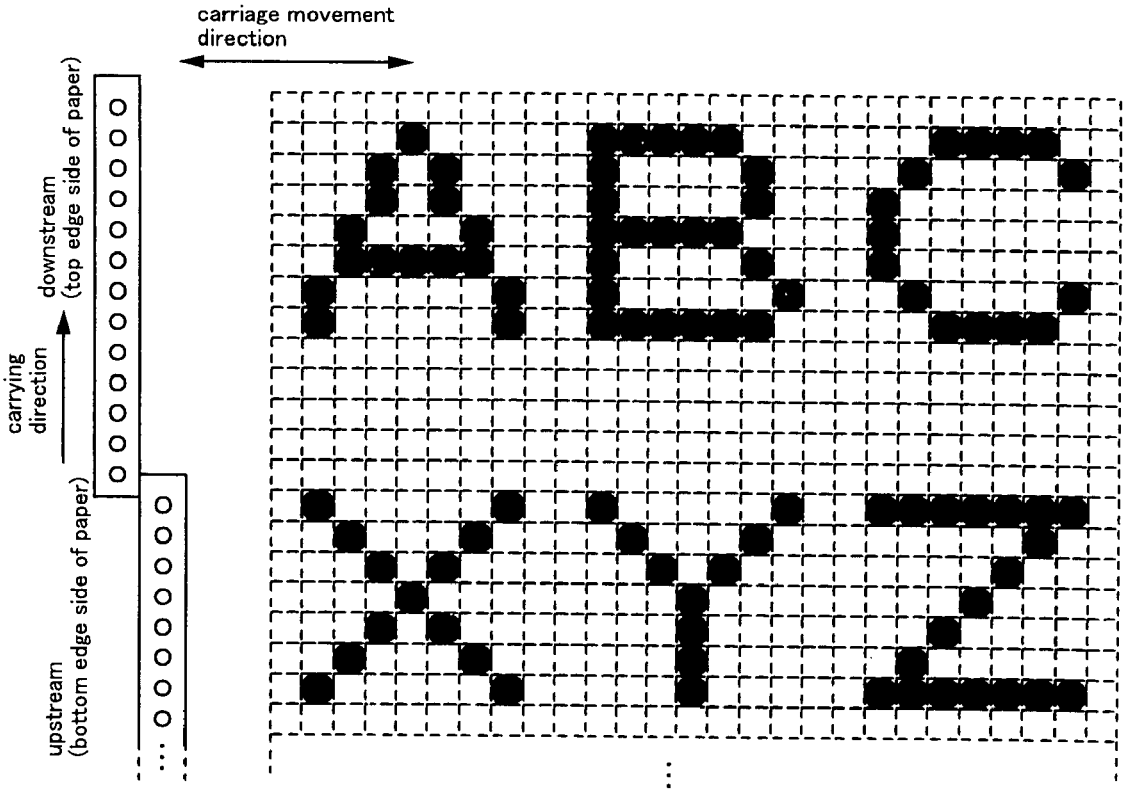
FIG. 26 is an explanatory diagram of the results of printing according to the present embodiment.

FIG. 26 is an explanatory diagram of the results of printing according to the second embodiment. If the pixel data is "0," ink is not ejected from the nozzles, and if the pixel data is "1," ink is ejected from the nozzles. As a result, dots are formed at positions on the paper corresponding to the pixels for which the pixel data is "1." A row of dots is formed by each nozzle ejecting ink droplets while moving during the dot formation process. For example, the nozzle #2 forms a dot row which is made up of ten dots. As each nozzle forms a dot row, the printed image "ABC XYZ" is composed.

According to the second embodiment, the printed image "XYZ" is printed by the first dot formation operation. For this reason, there is no seam in the printed image "XYZ" and the image quality does not deteriorate. Furthermore, the carrying process is stable since the carry amount is fixed (here, a carry amount amounts to 13 lines) during the carrying operation performed between dot formation operations (for example, the carrying operation performed between the dot formation operation for printing the printed image "ABC" and the dot formation operation for printing the printed image "XYZ").

<(2) The Printing Method>

In the second embodiment, there was only one first blank section. However, there may be a plurality of the first blank section. The plurality of the first blank section may each be expanded.

For example, if there are two of the first blank sections, a determination is made in step S405 described above as to whether or not the width of the image between the second blank section and the blank section upstream in the carrying direction is narrower than the width of the print target area. For example, when expanding the first blank section by two lines, the two first blank sections are each expanded by one line in step S407 described above.

If the widths of the two first blank sections differ, each blank section may be expanded according to the width of those blank sections (e.g., according to the ratio of the widths of the blank sections). For example, when expanding the first blank section by three lines, the wider of the two first blank sections may be expanded by two lines, while the narrower one may be expanded by one line, in step S407 described above.

<(2) The Expansion Process>

In the second embodiment, the printer driver performed the expansion process (specifically, the computer in which the printer driver is installed). However, the printer itself may perform the expansion process. In this case, the printer-side controller 60 of the printer analyzes the print data received from the printer driver according to the programs stored in the memory 63, and performs the expansion process by rearranging the pixel data in the print data as needed. In a case in which the printer performs the expansion process like this, the printer itself becomes the printing system.

OTHER EMBODIMENTS

The foregoing embodiment described primarily a printer. However, it goes without saying that the foregoing description also includes the disclosure of printing apparatuses, recording apparatuses, liquid ejection apparatuses, printing methods, recording methods, liquid ejection methods, printing systems, recording systems, computer systems, programs, storage media storing programs, display screens, screen display methods, and methods for producing printed material, for example.

Also, a printer, for example, serving as an embodiment was described above. However, the foregoing embodiment is for the purpose of elucidating the present invention and is not to be interpreted as limiting the present invention. The present invention can of course be altered and improved without departing from the gist thereof, and includes equivalents. In particular, the embodiments mentioned below are also included in the invention.

<The Nozzles>

In the foregoing embodiment, ink was ejected using piezoelectric elements. However, the method for ejecting liquid is not limited to this. Other methods, such as a method for generating bubbles in the nozzles through heat, may also be employed.

Overview (1-1) A printing system made up of a printer 1 and a computer 110 according to the first embodiment is provided with a carry unit 20 for carrying paper (a medium) in a carrying direction and a carriage 31 for moving in a movement direction a plurality of nozzles which are aligned in the carrying direction. A computer-side controller which is made up of a CPU 162 and a memory 163 and a printer-side controller 60 (hereafter the computer-side controller and the printer-side controller 60 are jointly referred to as the "controller") print a printed image on paper by repeating in alternation a formation operation for forming an image on paper by ejecting ink from a plurality of nozzles, which are moving, and a carrying operation for causing the carry unit to carry the paper.

At this stage a deterioration of image quality occurs along a seam when the printed image is formed in two formation operations (see FIG. 10 and FIG. 11A).

To resolve this, in the first embodiment, when there is a first blank section, which is arranged along the movement direction, within the image to be printed during a certain formation operation, there is a second blank section, which is arranged along the movement direction, within the image to be printed during the next formation operation, and a width W2 in the carrying direction of the image to be printed downstream in the carrying direction from the second blank section during the next formation operation is narrower than a width W1 in the carrying direction of the first blank section, the controller shortens the width in the carrying direction of the first blank section. The controller then prints the image to be printed between the first blank section and the second blank section during the certain formation operation.

This prevents a deterioration of image quality from occurring at the seam of the printed image, as, for example, the image "XYZ" in FIG. 11B is printed in a single formation operation. The number of formation operations can also be reduced, thereby making it possible to reduce the print time.

(1-2) In the printing system of the first embodiment, the carriage 31 is movable back and forth. The printing apparatus performs bi-directional printing (printing in which a formation operation is performed by the carriage moving in a forward-pass direction, a carrying operation is performed, and a formation operation is performed by the carriage moving in a return-pass direction).

In bi-directional printing, a deviation tends to arise between the landing location of the ink in the forward pass and the landing location in the return pass, often causing the image quality to deteriorate at the seam of the printed image. For this reason, the first embodiment is particularly effective for bi-directional printing.

Note, however, that the shortening process described above may also be performed in cases where bi-directional printing is not performed.

(1-3) In the printing system of the first embodiment, the width in the carrying direction of the first blank section is shortened if the first blank section is made up of a plurality of blank sections and the width (3 lines in FIG. 18) in the carrying direction of the image to be printed during the next formation operation on the downstream side in the carrying direction from the second blank section is smaller than the total of the widths (six lines in FIG. 18) in the carrying direction of the plurality of blank sections.

Deterioration of image quality at the seam in the printed image can also be suppressed in this way.

(1-4) In the printing system of the first embodiment, the widths in the carrying direction of each blank section are shortened according to the widths in the carrying direction of the plurality of blank sections, when shortening the width in the carrying direction of the first blank section. For example, in FIG. 18, the upper blank section is shortened by two lines and the lower blank section is shortened by one line, in accordance with the ratio of the widths of each blank section. This makes it possible to achieve a printed image closer to the original image.

Note, however, that it is also possible to shorten only one blank section of the plurality of blank sections. However, in this case, the printed image changes significantly compared to the original image.

(1-5) In the printing system of the first embodiment, the width in the carrying direction of the first blank section is shortened if the width W2 in the carrying direction of the image to be printed during the next formation operation on the downstream side in the carrying direction from the second blank section is equal to or lower than a threshold value. This is because the difference between the original image and the printed image grows larger if the shortened width in the first blank section is large.

Note, however, that it is also possible to perform the shortening process as long as the width W2 is smaller than the width W1, without setting a threshold value.

(1-6) In the printing system of the first embodiment, the pixel data corresponding to pixels arranged in a matrix are rearranged, and the width in the carrying direction of the first blank section of the image composed of the pixel data is shortened (see FIG. 15B). For example, as shown in FIG. 15A, the pixel data corresponding to the pixels upstream in the carrying direction from the first blank section are rearranged so that the pixel data corresponding to the pixels between the first blank section and the second blank section is associated with the nozzles in the same formation operation. The image to be printed between the first blank section and the second blank section is thereby printed in a single formation operation.

Note, however, that the original image may be processed to shorten the blanks in the image before resolution conversion, instead of rearranging the pixel data. The same effect as the above can be achieved by generating print data based on the processed image.

(1-7) In the printing system of the first embodiment, the first blank section and the second blank section are detected after performing halftone processing which reduces the gradation value of the pixel data. The calculation load is smaller when detecting blank sections based on two-gradation pixel data (the pixel data after performing halftone processing) than when detecting blank sections based on the 256-gradation pixel data (the pixel data before performing halftone processing).

Note, however, that the shortening process can also be performed based on the 256-gradation pixel data before being halftoned.

(1-8) In the printing system of the first embodiment, the image is text. This is because in text images blanks are often set between lines. Note, however, that the images under consideration may be natural images, and are not limited to text.

(1-9) With a printing system including all the component elements described above, all the effects can be achieved.

(1-10) In the printing method of the first embodiment, the carrying operation for carrying the paper in the carrying direction and the formation operation for forming the image on the paper by ejecting the ink from the plurality of nozzles which are aligned in the carrying direction and move in the movement direction are repeated in alternation.

In the printing method of the first embodiment, the first blank section, which is arranged along the movement direction, is first detected from the image to be printed during a certain formation operation (S201). Thereafter, the second blank section, which is arranged along the movement direction, is detected from the image to be printed during the next formation operation (S203). Then, if the first blank section and the second blank section are detected ("Yes" at S202 and S204) and the width W2 in the carrying direction of the image to be printed downstream in the carrying direction from the second blank section during the next formation operation is narrower than the width W1 in the carrying direction of the first blank section (S205: "Yes), then the width in the carrying direction of the first blank section is shortened (S206) in order to print, during the certain formation operation, the image to be printed between the first blank section and the second blank section.

The image to be printed between the first blank section and the second blank section is thereby printed in a single formation operation.

(1-11) The computer (print control apparatus) in which is installed the printer driver of the first embodiment controls via the print data the printer (printing apparatus), which repeats in alternation the carrying operation for carrying the paper in the carrying direction and the formation operation for forming the image on the paper by ejecting the ink from the plurality of nozzles which are lined up in the carrying direction and move in the movement direction.

The printer driver of the first embodiment causes this computer to (a) detect a first blank section, which is arranged along the movement direction, from the image to be printed during a certain formation operation, (b) detect a second blank section, which is arranged along the movement direction, from the image to be printed during the next formation operation, and (c) shorten the width in the carrying direction of the first blank section in order to print, during the certain formation operation, the image to be printed between the first blank section and the second blank section, if the first blank section and the second blank section are both detected and the width W2 in the carrying direction of the image to be printed downstream in the carrying direction from the second blank section during the next formation operation is narrower than the width W1 in the carrying direction of the first blank section.

The printer driver of the first embodiment can thereby cause the computer to generate print data which corresponds to the image thus generated. When the printer driver causes the computer to transmit the print data to the printer, the printer prints the image to be printed between the first blank section and the second blank section in a single formation operation in accordance with the print data.

(1-12) With the printer (printing apparatus) of the first embodiment, the carrying operation for carrying the paper in the carrying direction and the formation operation for forming the image on the paper by ejecting the ink from the plurality of nozzles which are lined up in the carrying direction and move in the movement direction are repeated in alternation.

The printer driver and the printer-side program of the first embodiment thus cause the printer to shorten the width in the carrying direction of the first blank section and print the image to be printed between the first blank section and the second blank section during the certain formation operation, if: (condition 1) the first blank section, which is arranged along the movement direction, is present within the image to be printed during the certain formation operation; (condition 2) the second blank section, which is arranged along the movement direction, is present within the image to be printed during the next formation operation; and (condition 3) the width W2 in the carrying direction of the image to be printed downstream in the carrying direction from the second blank section during the next formation operation is narrower than the width W1 in the carrying direction of the first blank section.

The printer driver and the printer-side program of the first embodiment can thus cause the printer to print the image to be printed between the first blank section and the second blank section in a single formation operation.

(2-1) A printing system made up of a printer 1 and a computer 110 according to the second embodiment is provided with a carry unit 20 for carrying paper (a medium) in a carrying direction and a carriage 31 for moving in a movement direction a plurality of nozzles which are lined up in the carrying direction. A computer-side controller which is made up of a CPU 162 and a memory 163 and a printer-side controller 60 (hereafter the computer-side controller and the printer-side controller 60 are jointly referred to as the "controller") print a printed image on paper by repeating in alternation a dot formation operation for forming an image on paper by ejecting ink from a plurality of nozzles, which are moving, and a carrying operation for causing the carry unit to carry the paper by a predetermined carry amount.

Deterioration of image quality occurs at a seam when the printed image is formed in two formation operations by the printing system (see FIG. 10 and FIG. 20A). It is conceivable that (as in the reference example), the image downstream in the carrying direction from the blank lines (the image "ABC" in FIG. 20B) is first printed, the paper is carried by a carry amount smaller than the predetermined carry amount, and the image upstream in the carrying direction from the blank lines (the image "XYZ" in the FIG. 20B) is printed in the next dot formation process. However, with this printing system, the carrying operation cannot be performed in a stable manner, as printing is performed by changing the carry amount in the middle of the printing process.

In the present embodiment, the controller expands a first blank section when the first blank section is present in the image to be printed during a certain dot formation process. The controller then first prints the image (the image "ABC" in FIG. 20C) on the downstream side in the carrying direction from the first blank section, carries the paper by the predetermined carry amount, and prints the image (the image "XYZ" in FIG. 20C) on the upstream side in the carrying direction from the first blank section in the next dot formation operation.

With this, it is possible to eliminate seams in the printed image and perform printing at a constant carry amount.

(2-2) In the printing system of the second embodiment, the image to be printed upstream in the carrying direction from the first blank section (the upper side of the image "XYZ" in FIG. 22) is printed in the dot formation operation for printing the image to be printed downstream in the carrying direction from the first blank section (the image "ABC" in FIG. 22), if the width in the carrying direction of the image (the image "XYZ" in FIG. 22) to be printed between the first blank section (the blank section within the image to be printed in a certain formation operation) and the second blank section (an other blank section within the image to be printed in the next formation operation) is larger that the width (13 lines in FIG. 24A) in the carrying direction of the image that can be printed on the paper in a single dot formation operation ("No" at step S405 in FIG. 25).

This is because there is no advantage in expanding the first blank section, because even if the first blank section is expanded, a seam will inevitably occur when the image downstream of the first blank section is printed.

(2-3) In the printing system of the second embodiment, the carriage 31 is movable back and forth. Bi-directional printing (printing in which a formation operation is performed by the carriage moving in a forward-pass direction, a carrying operation is performed, and a formation operation is performed by the carriage moving in a return-pass direction) is performed.

In bi-directional printing, a deviation tends to arise between the landing location of the ink in the forward pass and the landing location in the return pass, often causing the image quality to deteriorate at the seam of the printed image.

For this reason, the present embodiment is particularly effective for bi-directional printing.

Note, however that the expansion process described above may also be performed in cases where bi-directional printing is not performed.

(2-4) There may be a plurality of the first blank section. In this case, the image between the second blank section and the blank section, of among the first blank sections, on the upstream side in the carrying direction is printed in the next dot formation operation. Deterioration of image quality at the seam in the printed image can also be suppressed in this way.

(2-5) When there are a plurality of the first blank sections, the width of each blank section is expanded in accordance with the width of each blank section. This makes it possible to achieve a printed image closer to the original image.

Note, however, that it is also possible to expand only one blank section of the plurality of blank sections. However, in this case, the printed image changes significantly compared to the original image.

(2-6) In the printing system of the second embodiment, the width in the carrying direction of the first blank section is expanded if the width (2 lines in FIG. 24A) of the image (the upper side of the image "XYZ" in FIG. 24A) to be printed on the upstream side in the carrying direction from the first blank section within the first target area is equal to or lower than the threshold value. This is because the difference between the original image and the printed image grows larger if the expanded width in the first blank section is large.

However, the expansion process can also be performed without setting a threshold value.

(2-7) In the printing system according to the second embodiment, the pixel data corresponding to pixels arranged in a matrix are rearranged, and the width in the carrying direction of the first blank section of the image composed of the pixel data is thereby expanded (see FIG. 24B). For example, as shown in FIG. 24A, the pixel data corresponding to the pixels upstream in the carrying direction from the first blank section are rearranged so that the pixel data corresponding to the pixels between the first blank section and the second blank section is associated with the nozzles in the next formation operation. The width of the first blank section is thereby expanded and the image (the image "XYZ" in FIG. 24A) to be printed between the first blank section and the second blank section is printed in one formation operation.

Note, however, that the original image may be processed to expand the blanks in the image before resolution conversion, instead of rearranging the pixel data. The same effect as the above can be achieved by generating print data based on the processed image.

(2-8) In the printing system of the second embodiment, the first blank section and the second blank section are detected after performing halftone processing which reduces the gradation value of the pixel data. The calculation load is smaller when detecting blank sections based on two-gradation pixel data (the pixel data after performing halftone processing) than when detecting blank sections based on the 256-gradation pixel data (the pixel data before performing halftone processing).

Note, however, that the expansion process can also be performed based on the 256-gradation pixel data before being halftoned.

(2-9) In the printing system of the second embodiment, the image is text. This is because in text images blanks are often set between lines. Note, however, that the images under consideration may be natural images, and are not limited to text.

(2-10) With a printing system including all the component elements described above, all the effects can be achieved.

(2-11) In the printing method of the second embodiment, a carrying operation for carrying the paper in the carrying direction by a predetermined carry amount and a formation operation for forming the image on the paper by ejecting the ink from the plurality of nozzles which are aligned in the carrying direction and move in the movement direction are repeated in alternation.

In the printing method of the second embodiment, a first blank section, which is arranged along the movement direction, is first detected from the image to be printed during a certain formation operation (S401). Thereafter, a second blank section, which is arranged along the movement direction, is detected from the image to be printed during the next formation operation (S403). If the first blank section and the second blank section are detected ("Yes" at S402 and S404) and the width of the image between the first blank section and the second blank section is narrower than the width printable in a single dot formation operation (S405: "Yes), then the width in the carrying direction of the first blank section is expanded (S407) in order to print the image to be printed between the first blank section and the second blank section during the next formation operation.

With this, it is possible to eliminate seams in the printed image and perform printing at a constant carry amount.

(2-12) The computer (print control apparatus) in which is installed the printer driver of the second embodiment controls, via the print data, the printer (printing apparatus), which repeats in alternation the carrying operation for carrying paper in the carrying direction and the formation operation for forming an image on the paper by ejecting ink from a plurality of nozzles which are lined up in the carrying direction and move in the movement direction.

The printer driver in the second embodiment causes the computer (a) to detect a first blank section (a blank section which is arranged along the movement direction within the image to be printed during a certain dot formation operation) and (b) if the first blank section is detected, to expand the width in the carrying direction of the first blank section. As a result, the computer can cause the printer first to print the image to be printed downstream in the carrying direction from the first blank section, carry the paper by a predetermined carry amount, and print the image to be printed upstream in the carrying direction from the first blank section in the next dot formation operation.

The printer driver of the second embodiment can control the computer such that the printer prints a printed image with no seam using a constant carry amount.

(2-13) With the printer (printing apparatus) of the second embodiment, the carrying operation for carrying the paper in the carrying direction and the formation operation for forming the image on the paper by ejecting the ink from the plurality of nozzles which are lined up in the carrying direction and move in the movement direction are repeated in alternation.

The printer driver and printer-side program of the second embodiment cause the printer, if there is a first blank section, to first print the image to be printed downstream in the carrying direction from the first blank section, carry the paper by the predetermined carry amount, and print the image to be printed upstream in the carrying direction from the first blank section in the next dot formation operation.

The printer driver and printer-side program of the second embodiment can thereby cause the printer to print a printed image with not seams using a constant carry amount.

What is claimed is:

1. A printing method that repeats in alternation a transporting operation of transporting a medium in a transporting direction, and a formation operation of forming an image on said medium by ejecting ink from a plurality of nozzles that are aligned in said transporting direction and that move in a movement direction, said method comprising:

detecting, from an image to be printed in a certain formation operation, a first blank section that is arranged along said movement direction;

detecting, from an image to be printed in a next formation operation, a second blank section that is arranged along said movement direction; and in case where conditions in which said first blank section and said second blank section are detected and a width in said transporting direction of an image to be printed in said next formation operation on a downstream side in said transporting direction from said second blank section is smaller than a width in said transporting direction of said first blank section are met, then the width in said transporting direction of said first blank section is shortened in order to print, in said certain formation operation, an image to be printed between said first blank section and said second blank section;

in case where the conditions are not met, the width in said transporting direction of said first blank section is not shortened; and printing, that repeats in alternation said transporting operation of transporting said medium in said transporting direction, and said certain formation operation of forming said image on said medium by ejecting ink from said plurality of nozzles that are aligned in said transporting direction and that move in said movement direction.

2. A printing method according to claim 1, wherein said plurality of nozzles can be moved back and forth; and wherein said certain formation operation is performed while said plurality of nozzles move in a forward-pass direction, and after said transporting operation is performed, said formation operation is performed while said plurality of nozzles move in a return-pass direction.

3. A printing method according to claim 1, wherein, in case where the width in said transporting direction of the image to be printed in said next formation operation on the downstream side in said transporting direction from said second blank section is above a threshold value, then the conditions are not met.

4. A printing method according to claim 1, wherein the width in said transporting direction of said first blank section within said image that is made up of pixel data corresponding to pixels arranged in a matrix is shortened by rearranging said pixel data.

5. A printing method according to claim 1, wherein said first blank section and said second blank section are detected after halftone processing for lowering a gradation value of said pixel data has been performed.

6. A printing method according to claim 1, wherein said image is a text.

7. A printing method according to claim 1, wherein, if said first blank section is made up of a plurality of blank sections and the width in said transporting direction of the image to be printed in said next formation operation on the downstream side in said transporting direction from said second blank section is smaller than a total width in said transporting direction of said plurality of blank sections, then the total width in said plurality of blank sections is shortened.

8. A printing method according to claim 7, wherein, when shortening the width in said transporting direction of said first blank section, a width in said transporting direction of each of said plurality of blank sections is shortened in accordance with the width in said transporting direction of each of said plurality of blank sections.

9. A printing system comprising:

(A) a transporting unit that transports a medium in a transporting direction;

(B) a carriage that moves, in a movement direction, a plurality of nozzles that are aligned in said transporting direction; and (C) a controller that repeats in alternation a formation operation of forming an image on said medium by causing ejection of ink from said plurality of nozzles that are moving, and a transporting operation of causing said transporting unit to transport said medium, wherein:

the controller detects conditions comprising:

the controller detects a first blank section that is arranged along said movement direction within an image to be printed in a certain formation operation, the controller detects a second blank section that is arranged along said movement direction within the image to be printed in a next formation operation, and the controller further detects if a width in said transporting direction of an image to be printed in said next formation operation on a downstream side in said transporting direction from said second blank section is smaller than a width in said transporting direction of said first blank section, when the conditions are met, said controller shortens the width in said transporting direction of said first blank section and prints, in said certain formation operation, an image to be printed between said first blank section and said second blank section, in case where the condition are not met, the controller does not shorten the width in said transporting direction of said first blank section; and the controller instructs printing to be executed, that repeats in alternation with said transporting unit transporting said medium in said transporting direction, and the controller performing said certain formation operation of forming said image on said medium by ejecting ink from said plurality of nozzles that are aligned in said transporting direction and that move in said movement direction by the carriage.

* * * * *